US010745947B2

(12) United States Patent
Okeke et al.

(10) Patent No.: US 10,745,947 B2
(45) Date of Patent: Aug. 18, 2020

(54) AUTOMOTIVE LATCH INCLUDING BEARING TO FACILITATE RELEASE EFFORT

(71) Applicant: Magna Closures Inc., Newmarket (CA)

(72) Inventors: Uzochukwu Okeke, Bradford (CA); Kar Wang Woo, Markham (CA); Neil Guillermo, Richmond Hill (CA)

( * ) Notice: Subject to any disclaimer, the term of this patent is extended or adjusted under 35 U.S.C. 154(b) by 446 days.

(21) Appl. No.: 15/232,179

(22) Filed: Aug. 9, 2016

(65) Prior Publication Data

US 2017/0051540 A1 Feb. 23, 2017

Related U.S. Application Data

(60) Provisional application No. 62/344,069, filed on Jun. 1, 2016, provisional application No. 62/208,007, filed on Aug. 21, 2015.

(51) Int. Cl.

| | |
|---|---|
| ***E05B 85/26*** | (2014.01) |
| ***E05B 77/36*** | (2014.01) |
| ***E05B 17/00*** | (2006.01) |

(52) U.S. Cl.

CPC ..... *E05B 85/26* (2013.01); *E05B 17/007* (2013.01); *E05B 77/36* (2013.01)

(58) Field of Classification Search

CPC ..... E05B 85/26; E05B 17/007; E05B 77/36; E05B 81/14; E05B 65/0046; E05B 77/38; Y10T 292/1047; Y10T 292/1078; Y10T 292/1082; Y10T 292/14; Y10S 292/23; Y10S 292/56; Y10S 292/57; Y10S 292/58

See application file for complete search history.

(56) References Cited

U.S. PATENT DOCUMENTS 2,881,021 A * 4/1959 Jacobson ..... E05B 65/0046 292/216
4,569,544 A * 2/1986 Escaravage ..... E05B 81/14 292/201
4,588,217 A * 5/1986 Escaravage ..... E05B 81/14 292/201

(Continued)

FOREIGN PATENT DOCUMENTS

DE 102018113820 A1 * 12/2019 ..... E05B 85/26
DE 102018115048 A1 * 12/2019 ..... E05B 77/36

(Continued)

*Primary Examiner* — Alyson M Merlino

(57) ABSTRACT

A latch comprising: a housing having a slot for a striker; a ratchet rotationally mounted on the housing and biased for release of the striker from the slot and retaining of the striker in the slot dependent upon angular position of the ratchet with respect to the housing, the ratchet having a ratchet surface; a pawl rotationally mounted on the housing and biased towards the ratchet, the pawl having a pawl surface; and a rotatable bearing positioned between the pawl surface and the ratchet surface for rotation there between during rotation of the ratchet and the pawl, such that contact between the ratchet and the pawl is facilitated by one or more localized contact regions between an exterior surface of the bearing and adjacent respective at least one of the pawl surface or the ratchet surface; wherein the contact region is a localized contact region with respect to the exterior surface having a spheroidal shape.

23 Claims, 25 Drawing Sheets

(56) References Cited

U.S. PATENT DOCUMENTS

| | | | | | |
|---|---|---|---|---|---|
| 4,627,649 | A * | 12/1986 | Leplat | E05B 47/0657 | 292/216 |
| 5,188,406 | A | 2/1993 | Sterzenbach et al. | | |
| 5,931,512 | A * | 8/1999 | Fan | E05C 9/06 | 292/48 |
| 5,941,579 | A * | 8/1999 | Baniak | E05B 85/26 | 292/201 |
| 7,434,852 | B2 | 10/2008 | Spurr | | |
| 8,528,950 | B2 | 9/2013 | Organek et al. | | |
| 8,998,273 | B2 | 4/2015 | Debroucke et al. | | |
| 2018/0163439 | A1* | 6/2018 | Patane | E05B 85/26 | |
| 2019/0017301 | A1* | 1/2019 | Cumbo | E05B 85/26 | |

FOREIGN PATENT DOCUMENTS

| | | | | |
|---|---|---|---|---|
| EP | 0406777 | B1 | 3/1994 | |
| EP | 1512815 | B1 | 8/2007 | |
| EP | 1460211 | B1 | 7/2008 | |
| FR | 2472651 | A1 * | 7/1981 | E05B 77/38 |
| FR | 2528097 | A2 * | 12/1983 | E05B 81/20 |
| FR | 2701728 | A1 | 8/1994 | |

* cited by examiner

AUTOMOTIVE LATCH INCLUDING BEARING TO FACILITATE RELEASE EFFORT

FIELD OF THE INVENTION

This present invention relates to a latch assembly for securing and unsecuring vehicle components.

BACKGROUND

Undesirable high door latch release effort can be caused by frictional force between ratchet and pawl engagement. It is known that the friction force on engagement is directly related to a contact frictional coefficient and an automotive door seal load. Current state of the art systems for reducing friction between the ratchet and pawl can include a double pawl configuration, special low friction grease, and/or low friction plating. However, there remain disadvantages of the magnitude of release effort for these current systems, as well as undesirable noise of operation and manufacturing complexity.

Further disadvantages with current state of the art systems include required numerous different latch designs as different versioned arrangements of ratchet and pawl to suit different design constraints of latch operation depending upon the particular vehicle door configuration and latch footprint constraints. The ability to have a customizable latch design using similar ratchet and pawl components is desired, in order to match varying requirements in operational and/or footprint characteristics.

One prior art latch design is U.S. Pat. No. 5,941,579 that describes a pin slidably mounted within a guideway of a latch housing, such that the pin is positioned for rotation between a detent fork of a ratchet and a pawl of the latch. Disadvantages of this system relate to the type and magnitude of friction generated between the pin and the adjacent surfaces of the ratchet and pawl. Further, alignment of the ratchet with the pawl can be problematic for the overall operation of the latch. This art also positions the pin on the latch housing, something that can be inconvenient for different housing package designs of different automotive door/hood configurations.

SUMMARY

It is an object to the present invention to provide a latch assembly to obviate or mitigate at least one of the above-mentioned problems.

One solution is to facilitate door latch release efforts by introducing a preferable friction coefficient using a ball bearing positioned between ratchet and pawl engagement.

One solution is to facilitate door latch release efforts by introducing a preferable friction coefficient using a roller bearing positioned between ratchet and pawl engagement.

A first aspect provided is a latch comprising: a housing having a slot for a striker; a ratchet rotationally mounted on the housing and biased for release of the striker from the slot and retaining of the striker in the slot dependent upon angular position of the ratchet with respect to the housing, the ratchet having a ratchet surface; a pawl rotationally mounted on the housing and biased towards the ratchet, the pawl having a pawl surface; and a bearing cage positioned on a body of the pawl or on a body of the ratchet, the cage containing a bearing for rotation within the cage during rotation of the ratchet and the pawl, such that contact between the ratchet and the pawl is facilitated by one or more contact regions between an exterior surface of the bearing and adjacent respective at least one of the pawl surface or the ratchet surface.

A second aspect provided is a latch comprising: a housing having a slot for a striker; a ratchet rotationally mounted on the housing and biased for release of the striker from the slot and retaining of the striker in the slot dependent upon angular position of the ratchet with respect to the housing, the ratchet having a ratchet surface; a pawl rotationally mounted on the housing and biased towards the ratchet, the pawl having a pawl surface; and a rotatable bearing positioned between the pawl surface and the ratchet surface for rotation there between during rotation of the ratchet and the pawl, such that contact between the ratchet and the pawl is facilitated by one or more localized contact regions between an exterior surface of the bearing and adjacent respective at least one of the pawl surface or the ratchet surface; wherein the contact region is a localized contact region with respect to the exterior surface having a spheroidal shape.

FIGURES

The foregoing and other aspects will now be described by way of example only with reference to the attached drawings, in which.

Figure 2:
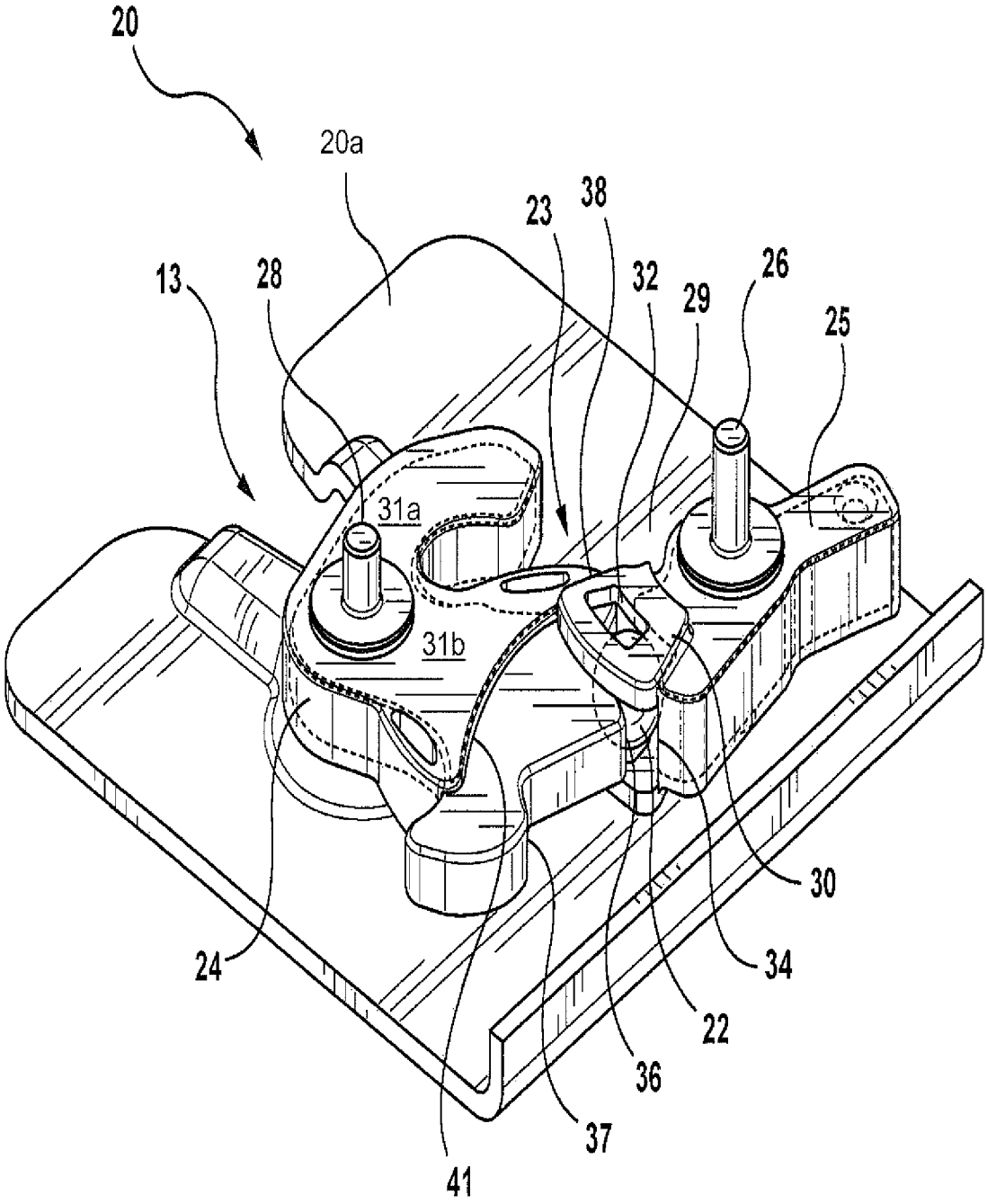
FIG. 2 is a plan view of a latch in the vehicle shown in FIG. 1.
Figure 4A:
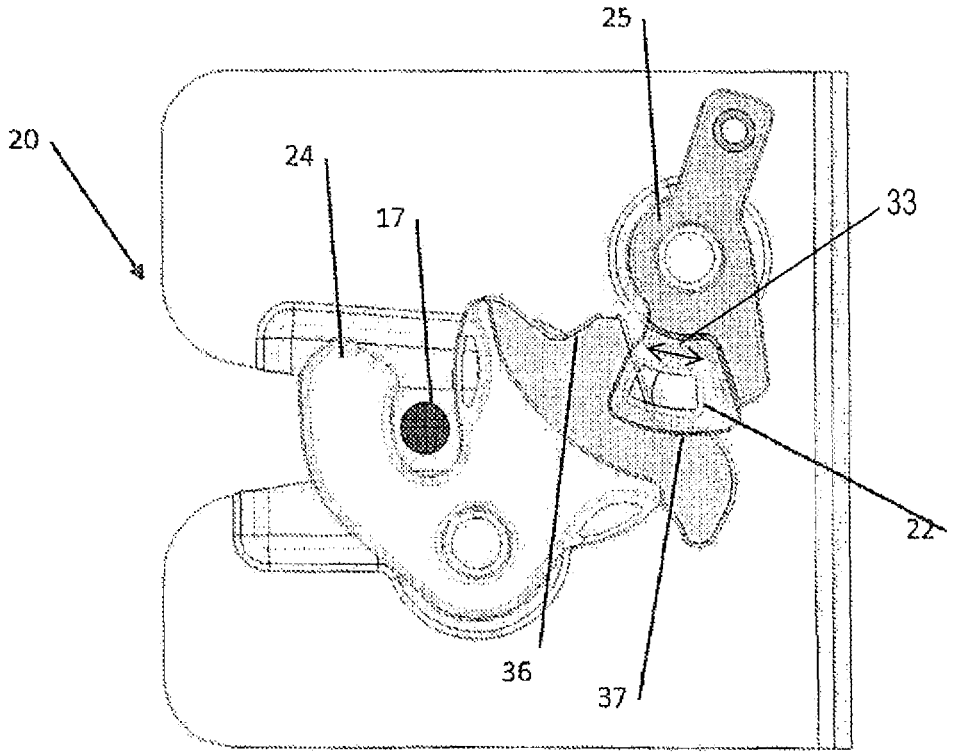
Figure 4B:
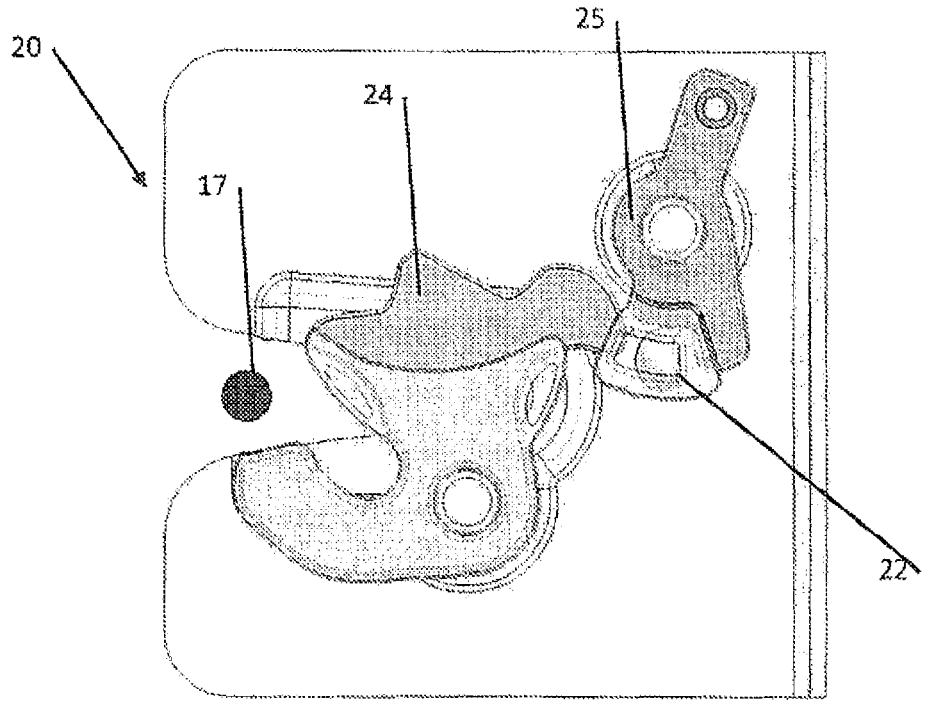
Figure 5:
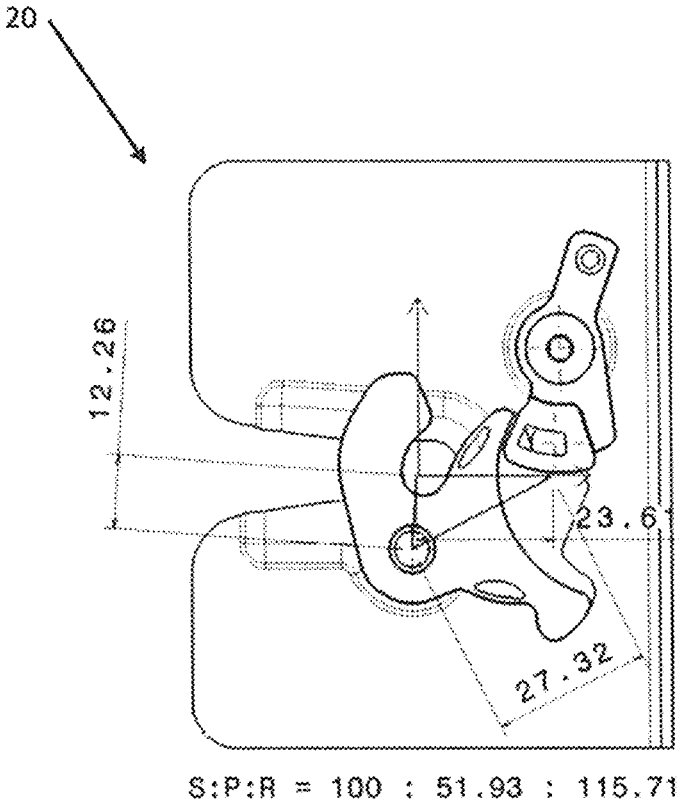

FIGS. 4*a* and 4*b* show operation of the latch shown in FIG. 2;

FIG. 5 shows example dimensions of the latch of FIG. 2.

Figure 1:
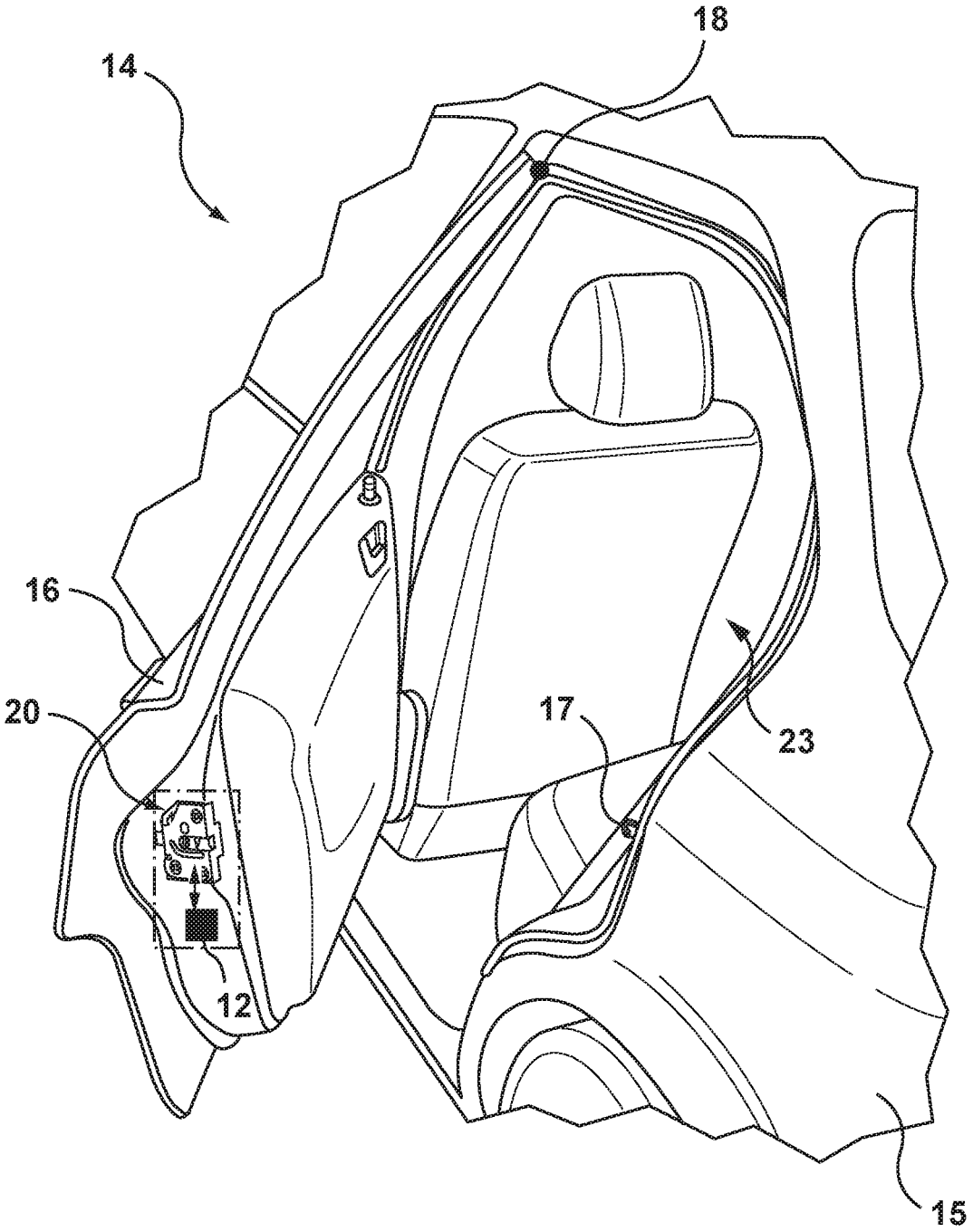
FIG. 1 is a perspective view of a vehicle.
Figure 9:
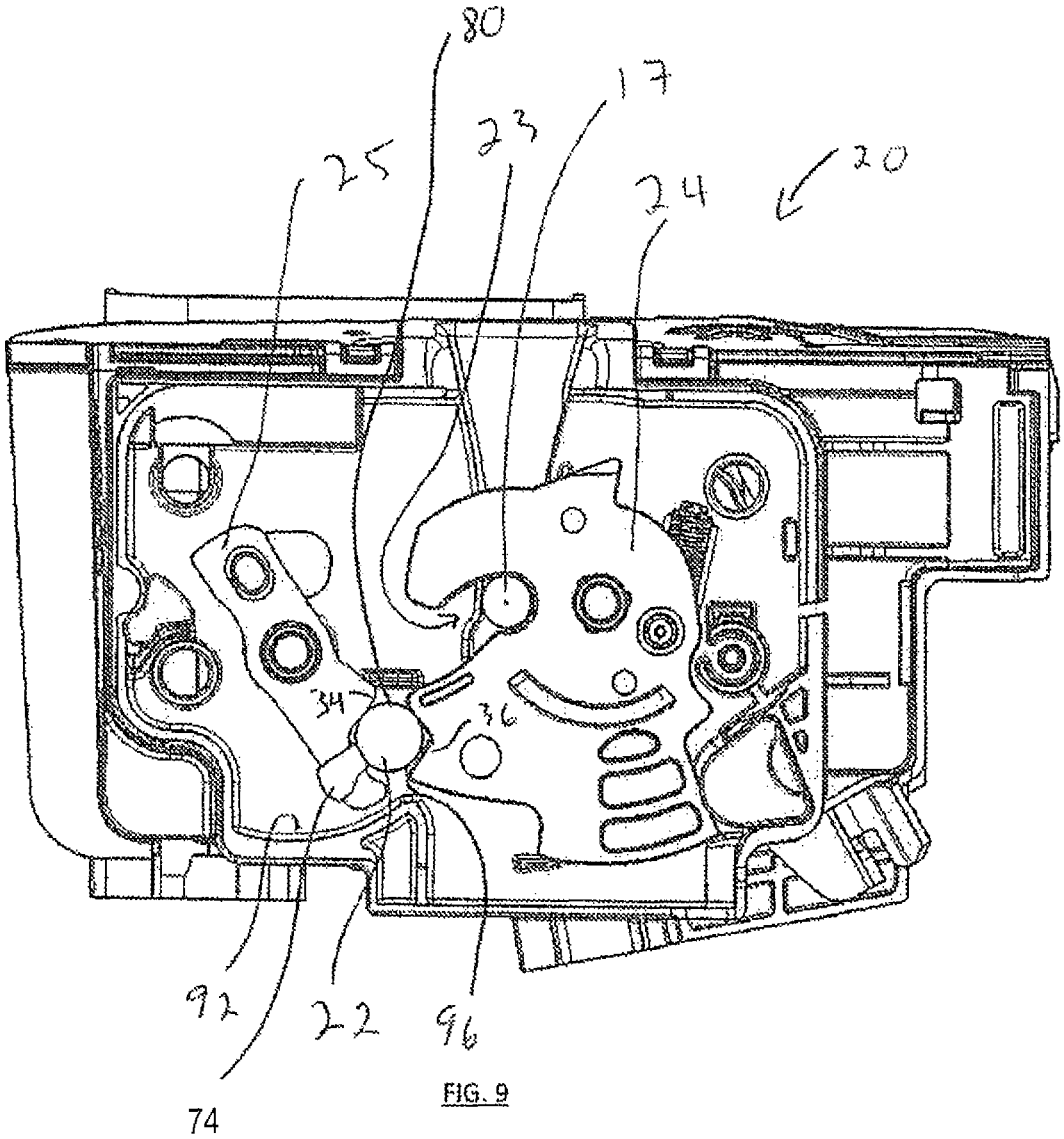
Figure 14:
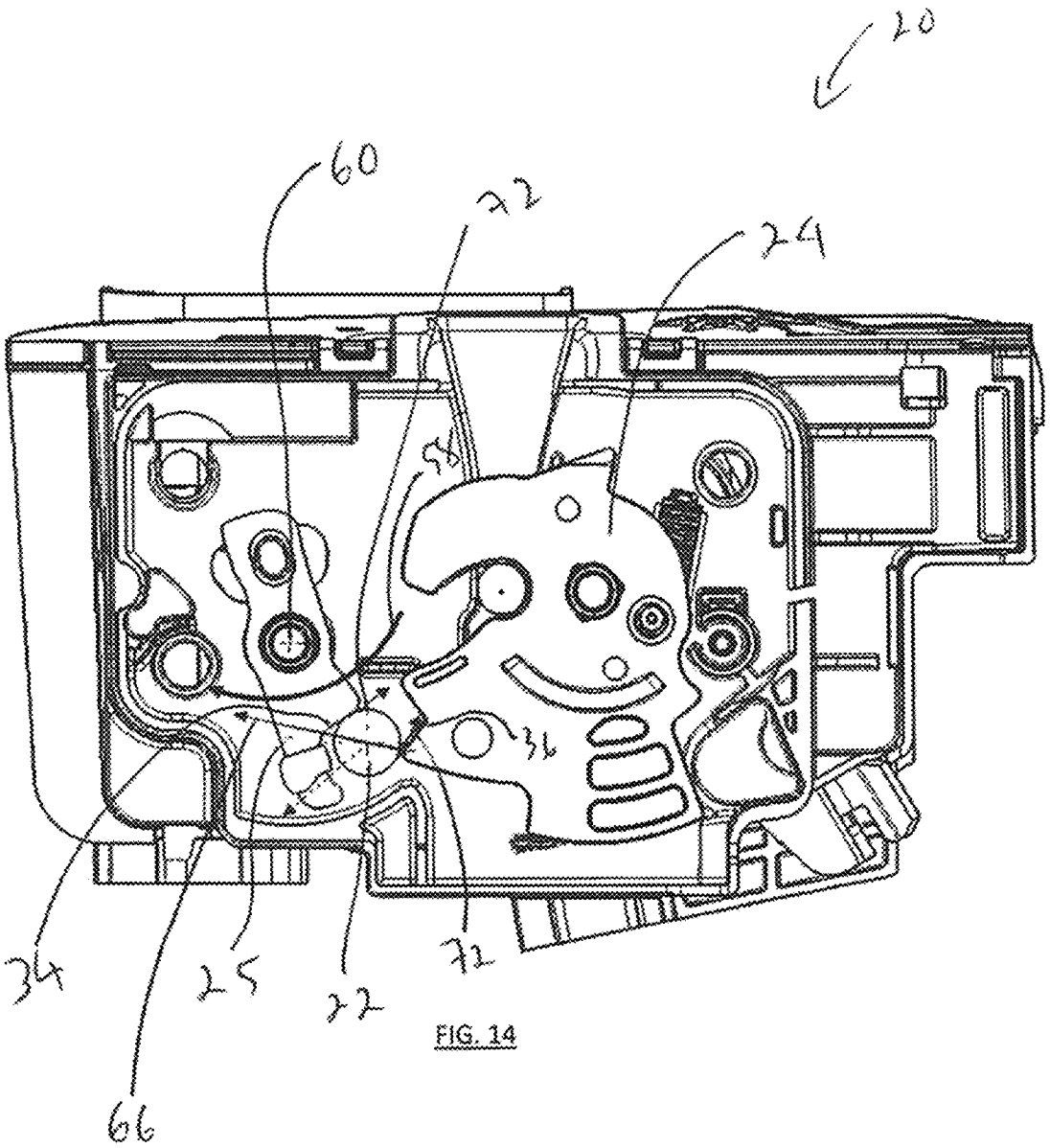
Figure 15:
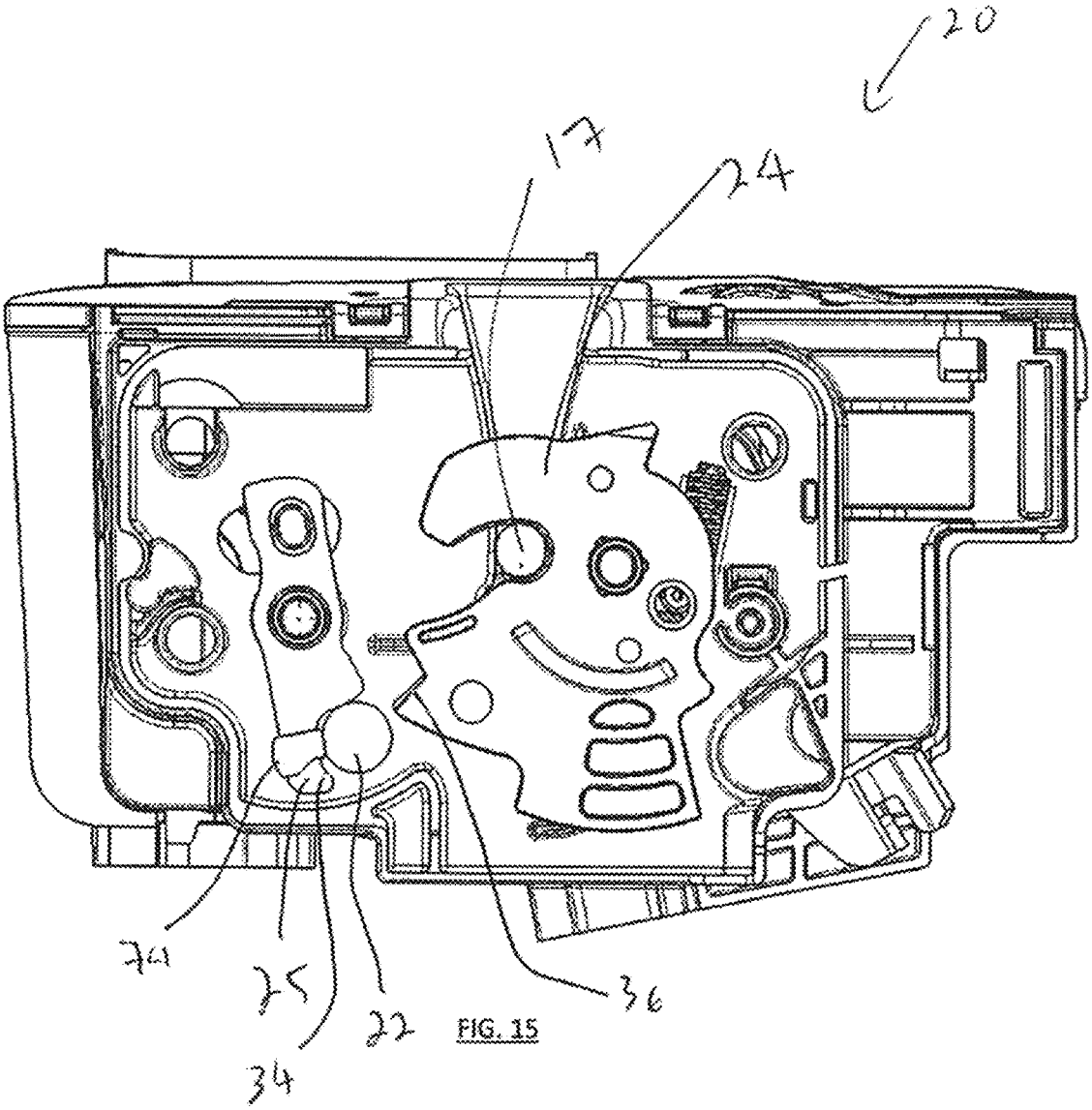
Figure 16:
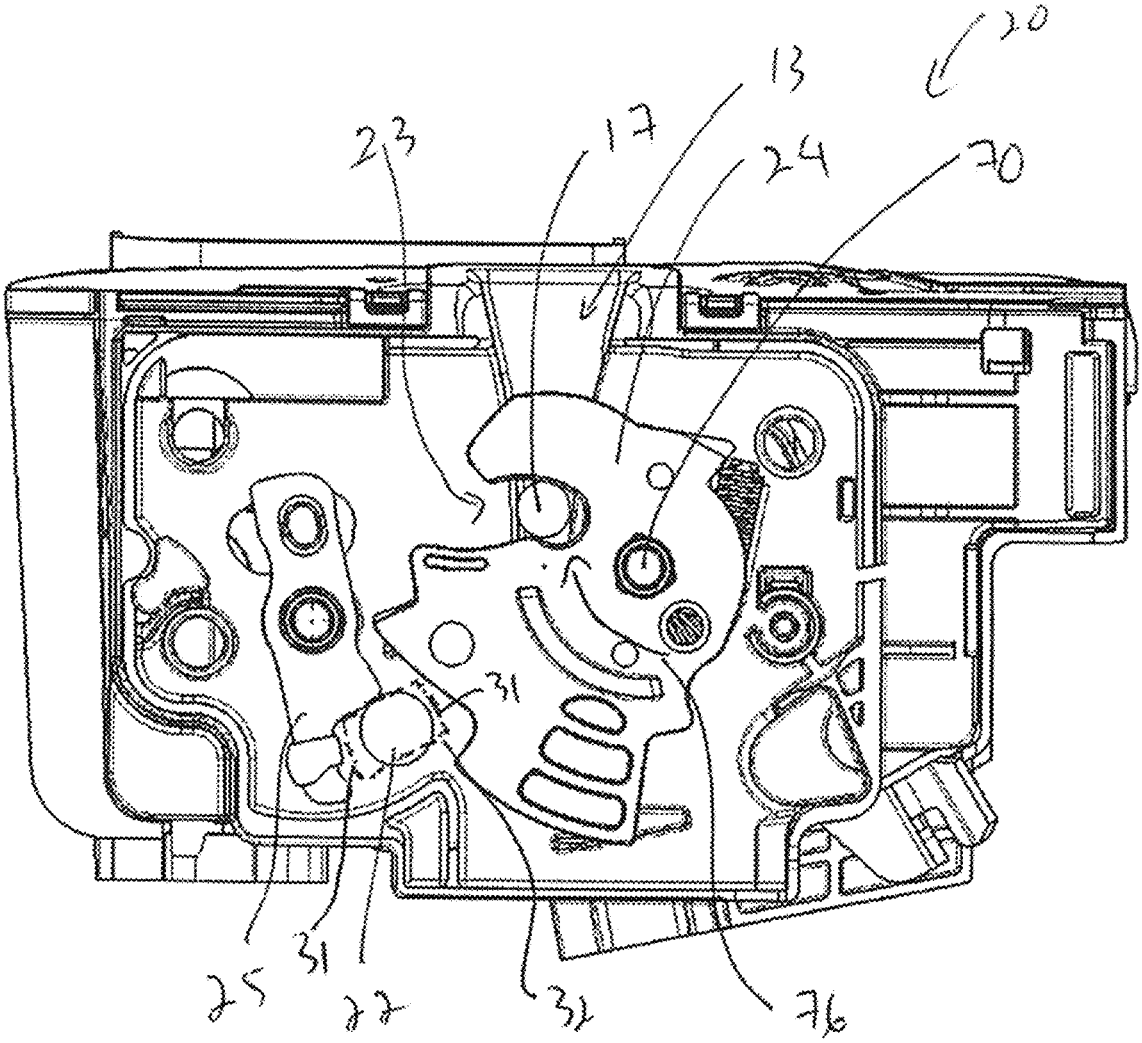
Figure 17:
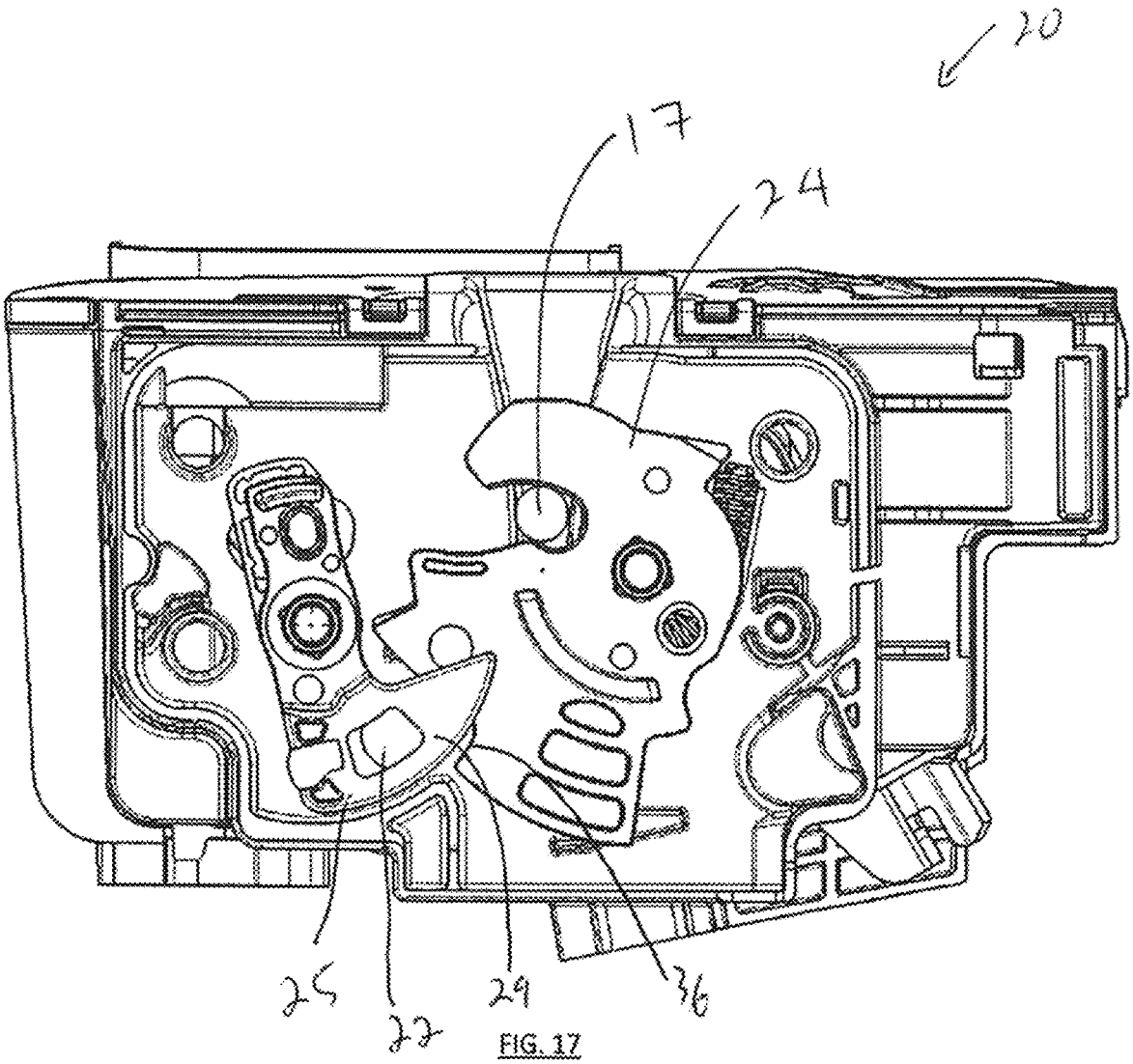
Figure 18:
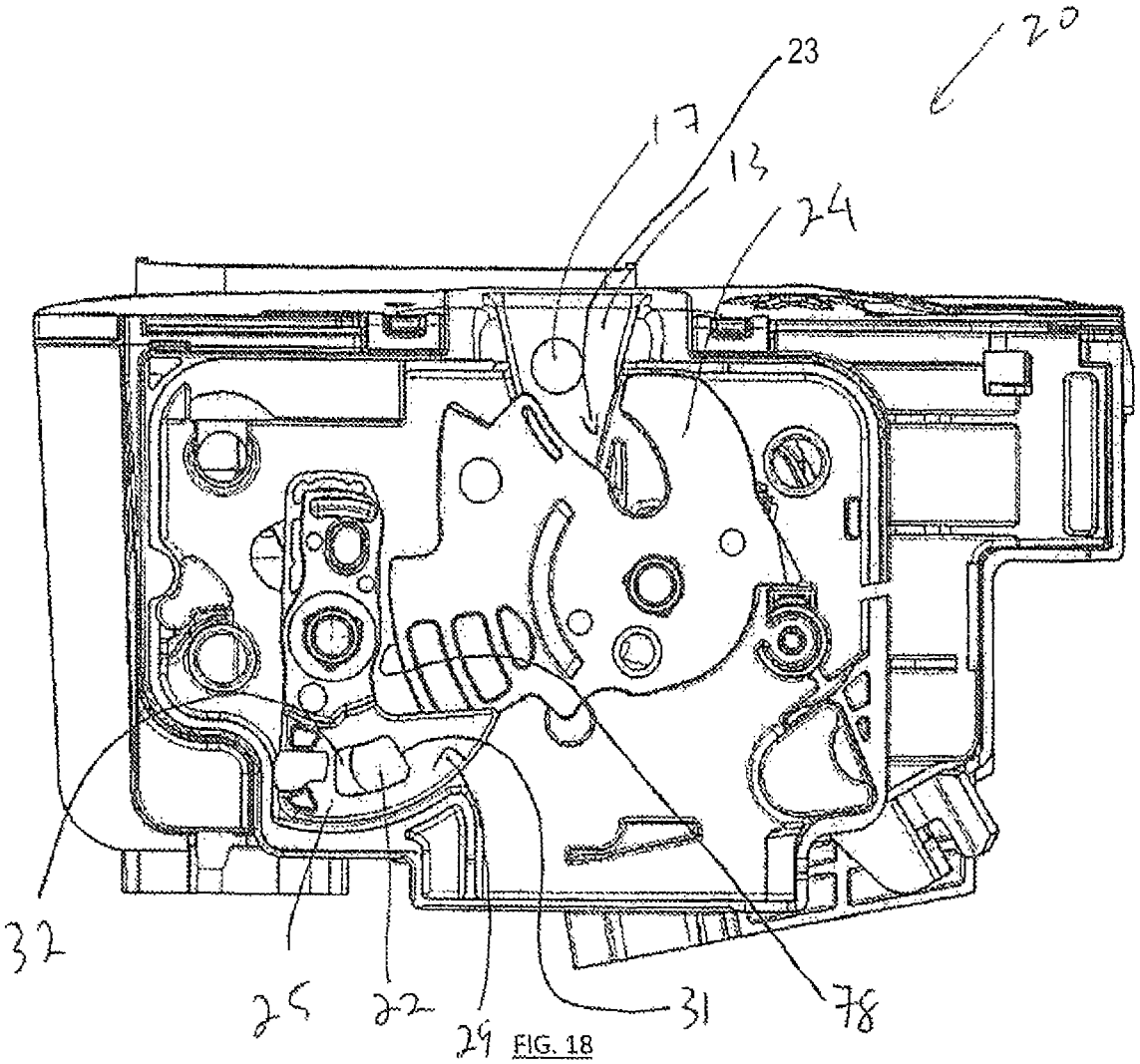
Figure 19:
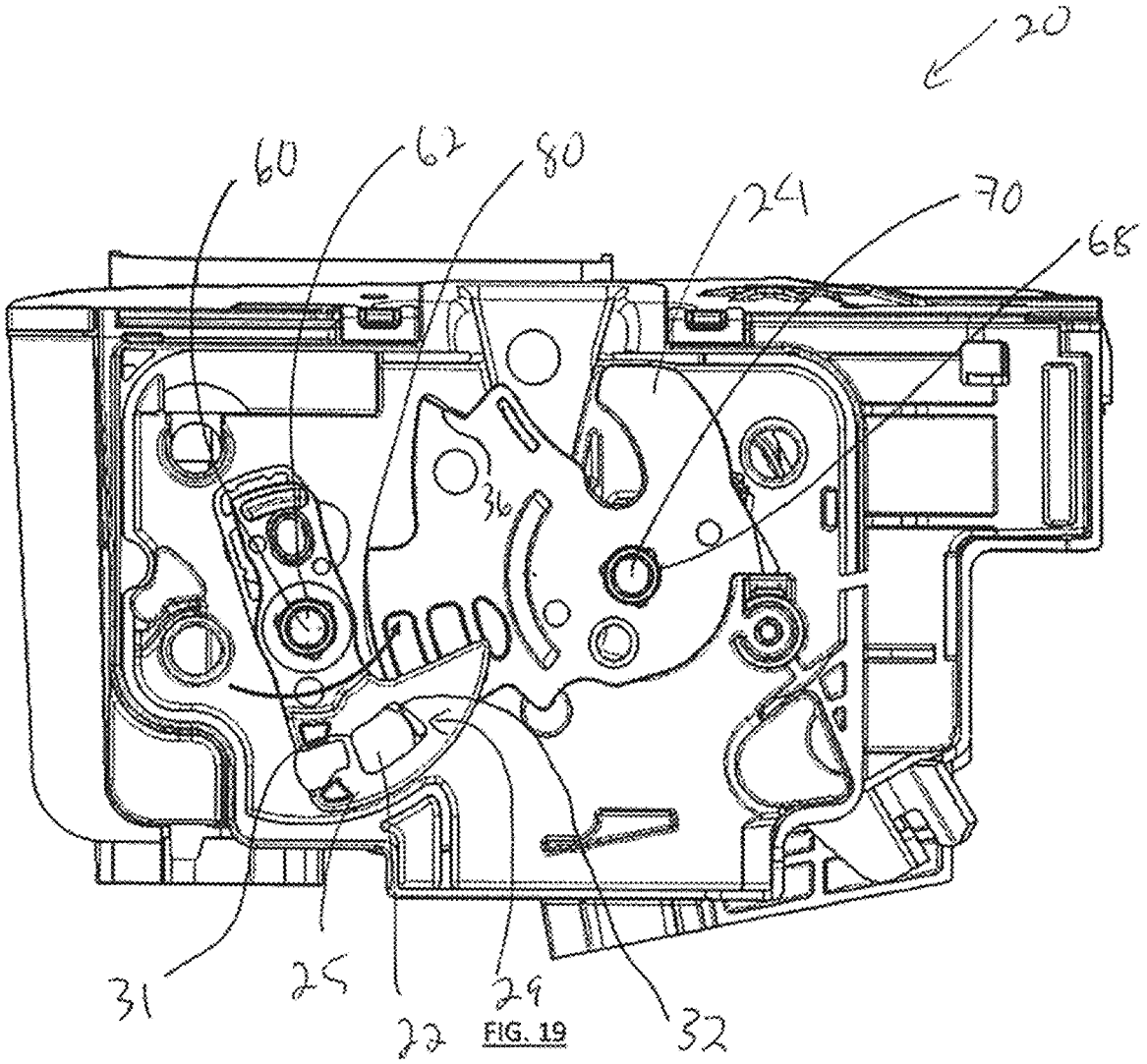
Figure 20:
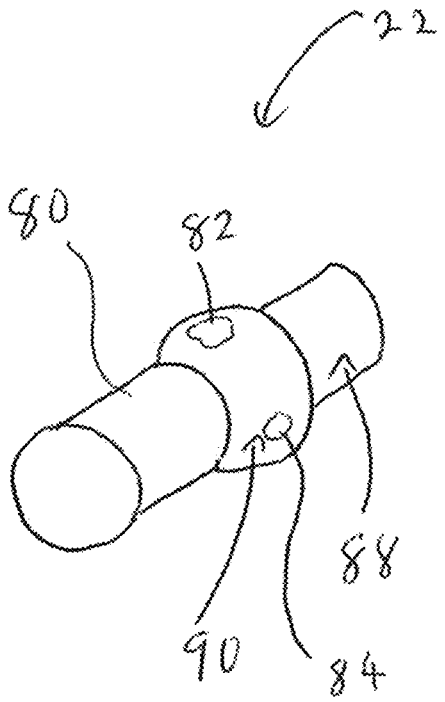

FIGS. 6*a*, 6*b*, 6*c*, 6*d* show an alternative embodiment of the latch of FIG. 2;

FIGS. 7*a*, 7*b*, 7*c*, 7*d* show a further alternative embodiment of the latch of FIG. 2;

FIGS. 8*a*, 8*b*, 8*c*, 8*d* show a further alternative embodiment of the latch of FIG. 2;

FIG. 9 is a further embodiment of the latch of FIG. 2 in a primary latch position;

FIGS. 10-13 show operation of the latch of FIG. 9 wherein a bearing is experiencing rolling friction;

FIGS. 14-15 show operation of the latch of FIG. 9 wherein the bearing is experiencing sliding friction;

FIGS. 16-17 show release of the ratchet from the pawl of the latch of FIG. 9;

FIG. 18 shows the ratchet of FIG. 17 in a fully open or released position;

FIG. 19 shows the latch of FIG. 9 in the open position with pawl in a home position;

FIG. 20 is an alternative embodiment of the bearing of FIG. 1; and

Figure 21:
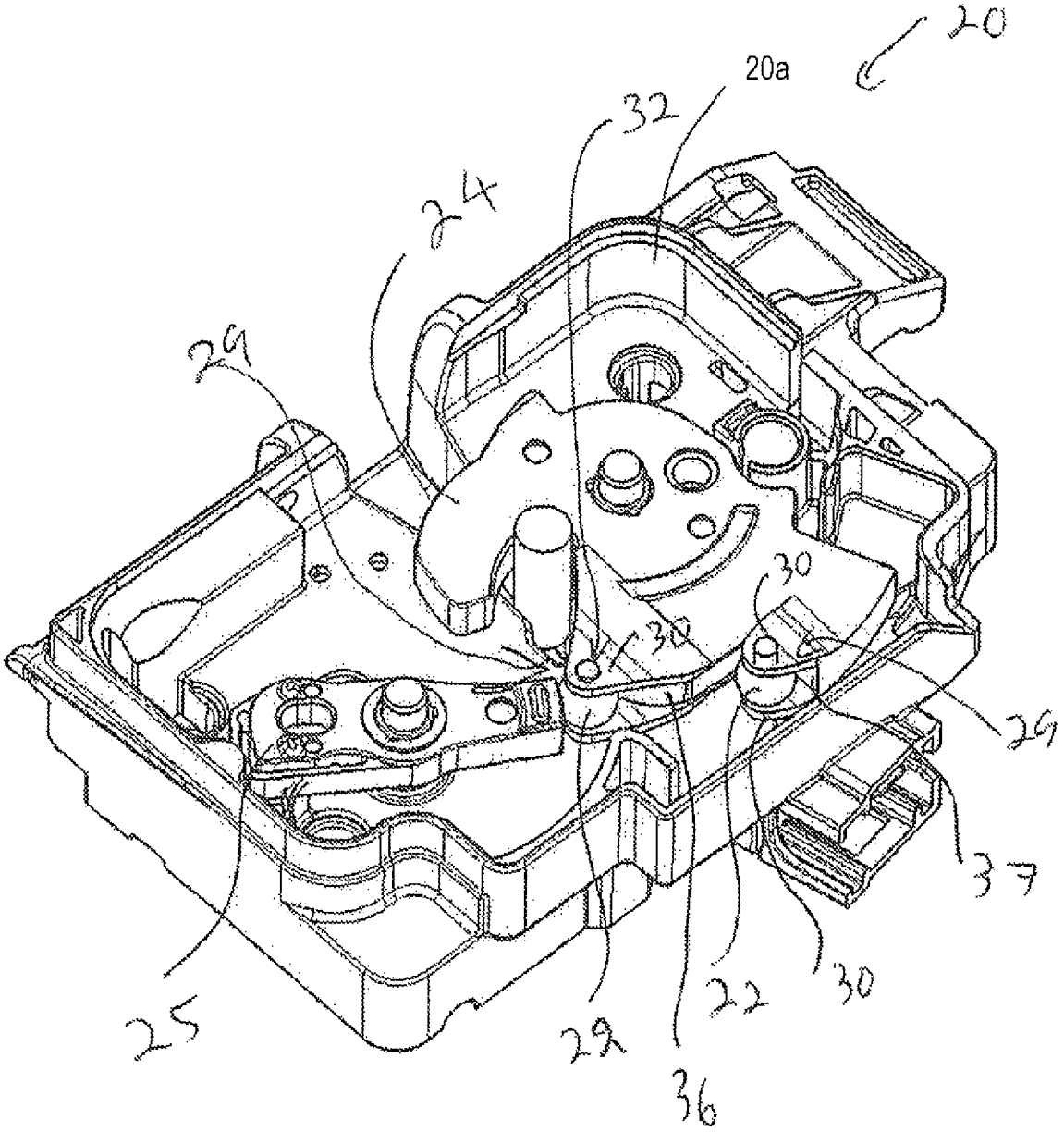
Figure 22:
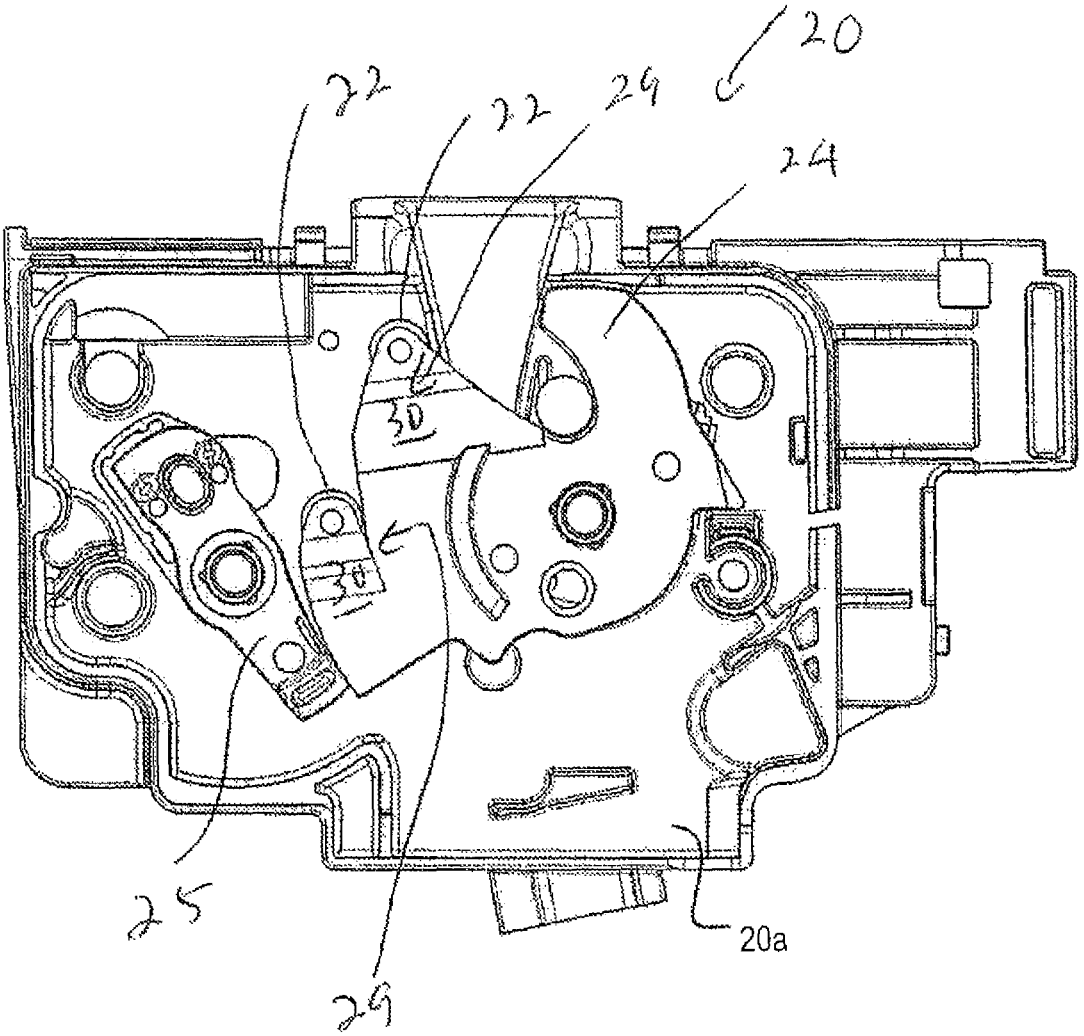

FIGS. 21 and 22 show an alternative embodiment of the latch of FIG. 1.

DESCRIPTION

Referring to FIG. 1, shown is a vehicle 14 with a vehicle body 15 having one or more closure panels 16 coupled to the vehicle body 15. It is recognized that the closure panel(s) 16 can be as shown or can be other than as shown. For example, the closure panel 16 can be a hood 16 with hood latch 20, a door 16 with door latch 20, a trunk 16 with a trunk latch 20, a seat latch 20, etc. The closure panel 16 is connected to the vehicle body 15 via one or more hinges 18 and a latch 20 (e.g. for retaining the closure panel 16 in a closed position once closed). It is also recognized that the hinge 18 can be configured as a biased hinge 18 to bias the closure panel 16 towards an open position and/or towards the closed position. As such, the hinge 18 can also incorporate one or more actuated struts to assist in opening and closing of the closure panel 16, as desired. The closure panel 16 has a mating latch component 17 (e.g. striker) mounted thereon for coupling with the latch 20 mounted on the vehicle body 15. Alternatively, latch 20 can be mounted on the closure panel 16 and the mating latch component 17 mounted on the body 15 (see FIG. 1).

Movement of the closure panel 16 (e.g. between the open and closed panel positions) can be electronically and/or manually operated by a latch controller 12, where power assisted closure panels 16 can be found on minivans, high-end cars, or sport utility vehicles (SUVs) and the like. As such, it is recognized that movement of the closure panel 16 can be manual or power assisted (e.g. using electronic latch controller 12) during operation of the closure panel 16 at, for example: between fully closed (e.g. locked or latched) and fully open (e.g. unlocked or unlatched); between locked/latched and partially open (e.g. unlocked or unlatched); and/or between partially open (e.g. unlocked or unlatched) and fully open (e.g. unlocked or unlatched). It is recognized that the partially open configuration of the closure panel 16 can also include a secondary lock (e.g. closure panel 16 has a primary lock configuration at fully closed and a secondary lock configuration at partially open—for example for latches 20 associated with vehicle doors).

In terms of vehicles 14, the closure panel 16 may be a door, a hood, a lift gate, or it may be some other kind of closure panel 16, such as an upward-swinging vehicle door (i.e. what is sometimes referred to as a gull-wing door) or a conventional type of door that is hinged at a front-facing or back-facing edge of the door, and so allows the door to swing (or slide) away from (or towards) the opening 23 in the body 15 of the vehicle 14. Also contemplated are sliding door embodiments of the closure panel 16 and canopy door embodiments of the closure panel 16, such that sliding doors can be a type of door that open by sliding horizontally or vertically, whereby the door is either mounted on, or suspended from a track that provides for a larger opening 23 for equipment to be loaded and unloaded through the opening 23 without obstructing access. Canopy doors are a type of door that sits on top of the vehicle 14 and lifts up in some way, to provide access for vehicle passengers via the opening 23 (e.g. car canopy, aircraft canopy, etc.). Canopy doors can be connected (e.g. hinged at a defined pivot axis and/or connected for travel along a track) to the body 15 of the vehicle at the front, side or back of the door, as the application permits. It is recognized that the body 15 can be represented as a body panel of the vehicle 14, a frame of the vehicle 14, and/or a combination frame and body panel assembly, as desired.

Figure 3:
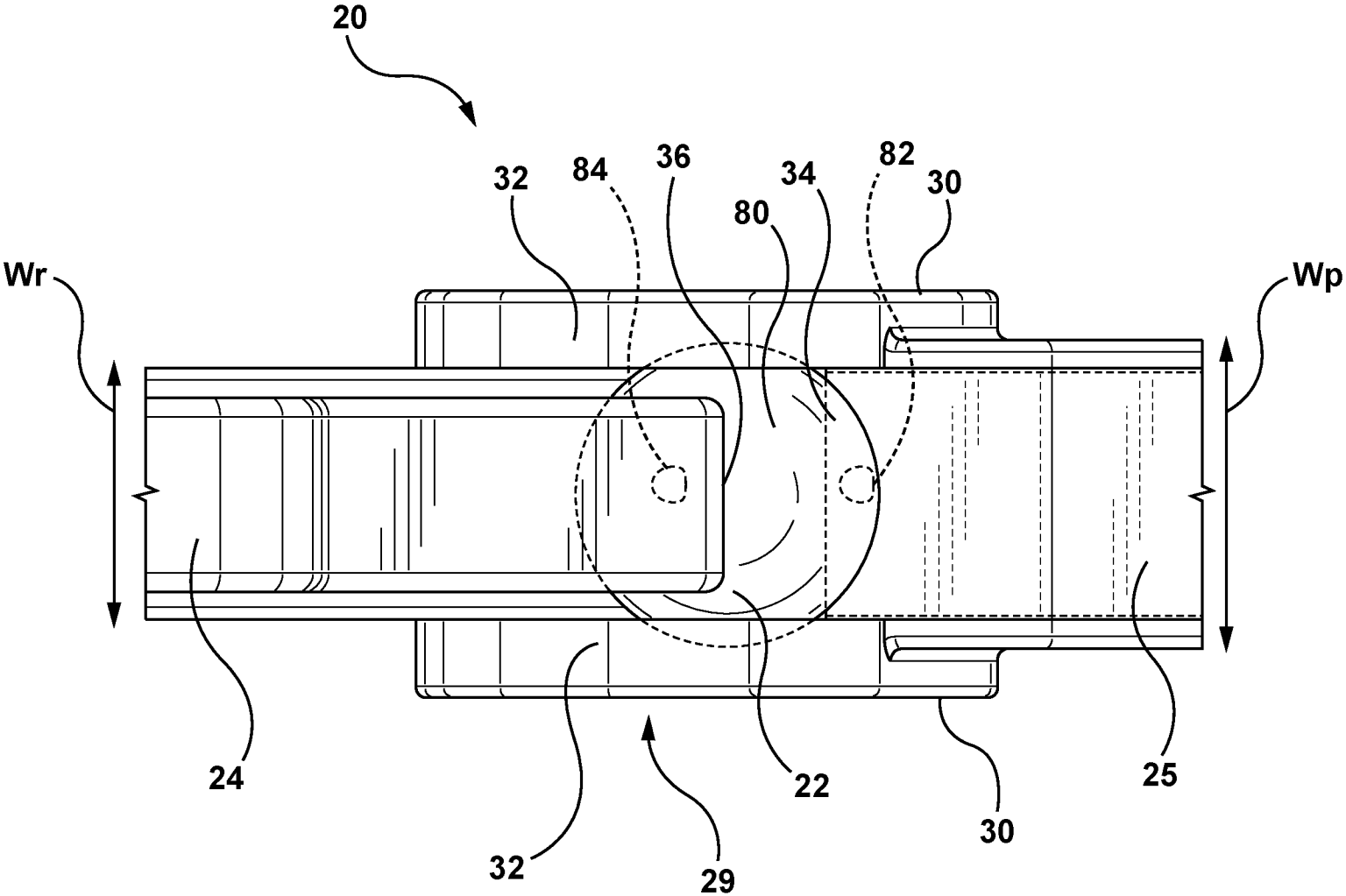
FIG. 3 is a side view of a portion of the latch shown in FIG. 2.

Referring to FIGS. 2, 3, the latch 20 includes a number of latch elements (e.g. ratchet 24, ball bearing 22 and pawl 25) that are configured to cooperate with the mating latch component 17 in order to retain the mating latch component 17 within a slot 13 when the closure panel 16 (see FIG. 1) is in the closed position (e.g. locked), or otherwise to drive the mating latch component 17 out of the slot 13 when the closure panel 16 is in the open position. The fish mouth or slot 13 is sized for receiving the mating latch component 17 therein, in other words the slot 13 of the latch 20 is configured for receiving a keeper (e.g. striker) of the mating latch component 17. The slot 13 has an open top end and a closed bottom end as shown. The latch elements of the ratchet 24 and pawl 25 are pivotally secured to the frame plate 23 via respective shafts or pins 28,26. The ratchet 24 includes an arm 31*a* and arm 31*b* spaced apart to define a generally u-shaped slot 23 there between. Note that in FIG. 4*a* the latch 20 with associated ratchet 24 are shown in the fully or primary closed position (e.g. facilitating the retention of the mating latch component 17 within the slots 13, 23), as the latch 20 in FIG. 4*b* is shown in the full open position, facilitating the release of the mating latch component from the slots 13,23. For example, using a hardened ball bearing 22 between the ratchet 24 and pawl 25 can facilitate an engagement contact change from directly between the adjacent surfaces 34,36 to a desired point contact (e.g. rolling contact between the exterior surface of the ball bearing 22 and the surfaces 34,36) with rolling friction less than 0.05 than what would be exhibited by sliding friction due to direct contact between the surfaces 34,36 (i.e. when no bearing 22 is positioned between the surfaces 34,36).

Referring again to FIGS. 2,3, the ball bearing 22 is mounted to a body of the pawl 25 by cage 29 having a pair of sidewalls 30 positioned on either side of the ball bearing 22. The sidewalls 30 are spaced apart and opposed to one another to accommodate positioning of the ball bearing 22 there between. Each of the sidewalls can have a slot 32 positioned therein for seating the ball bearing 22 within the cage 29. The slots 32 can be formed as recesses (e.g. grooves) in the sidewalls 30 and/or can be perforations (e.g. holes) in the sidewalls 30, as desired. As the ball bearing 22 is of a spherical shape, the ball bearing 22 is free to rotate in multiple rotational directions within the slots 32. The ball bearing 22 is also positioned between a surface 34 of the pawl 25 and a surface 36 of the ratchet 24, such that the ball bearing 22 can have one or more independent points of contact between an exterior surface of the ball bearing 22 and the surface(s) 34,36. For example, the surface(s) 34,36 can be of an arcuate (e.g. concave) or angled shape (e.g. L shaped) to facilitate retaining of the ball bearing 22 between the surfaces 34,36 when the latch is in the closed position (see FIG. 2). As such the arcuate or angled shape of the surface 34 of the pawl 25 and/or the surface 36 of the ratchet 24 can act as a cradle for the bearing 22 in order to support the bearing 22 and facilitate alignment of the bearing 22 in a desired orientation between the ratchet 24 and pawl 25.

It is also noted that the contact surfaces 34,36 are at different distances as measured from a common pivot point 26,28. As such, the pawl contact region (e.g. point) of the bearing 22 exterior surface with the contact surface 34 and the ratchet contact region (e.g. point) of the same bearing 22 exterior surface with the contact surface 36 are at different distances relative to the same pivot point 26,28. A consequence of these different distances is that the bearing 22 surface experiences rolling or rotation along a degree of freedom accorded by the slot 32 (or other mounting type—e.g. fixed axis of rotation via a pin—see FIGS. 7*a*,7*b*) along the contact surfaces 34,36, as the speed (of rotation) of each pawl contact region and ratchet contact location on the bearing 22 exterior surface is also the same. In this manner, it is recognized that the bearing 22 exterior surface can travel at the same speed (e.g. matched speeds) while having multiple contact regions (on pawl 25 and ratchet 24) each at different distances from a common pivot point 26,28, which therefore induces rotation of the bearing 22 afforded by the degree of freedom provided by the slots 32 or fixed rotational axis on the sidewall(s) 30 (i.e. how the bearing 22 is mounted directly to the pawl 25 or the ratchet 24). As such, rotation is induced on the bearing 22 since the speed (rolling) along one side of the bearing 22 exterior surface (adjacent to the pawl contact surface 34) is the same as the speed (rolling) along the other side of the bearing 22 exterior surface (adjacent to the ratchet contact surface 36), given the different distances of each of the separate contact surface 34 and contact surface 36 from a respective same pivot point 26 or same pivot point 28.

It is noted that the sidewalls 30 can be positioned on either side of the ratchet 24, such that at least a portion of the sidewalls 30 overlap the body of the ratchet 24, so that alignment between the ratchet 24 and the pawl 25 can be maintained during operational rotation of the pawl 25 and ratchet 24. Further, it is recognized that at least some overlap of the sidewalls 30 with the body of the ratchet 24 can be maintained at all times during relative travel between the pawl 25 and the ratchet 24, in order to inhibit interference in movement between the pawl 25 and the ratchet 24.

Each of the slots 32 of the cage 29 can have slot end abutments 31 (see FIG. 4*a*) for stopping travel of the bearing 22 along a length of the slot 32, when the bearing 22 reaches the end of the slot 32. For example, the slot end abutments 31 are positioned at either end of a length 33 of the slot 32. As such, e.g. see FIGS. 18, 19, the bearing 22 can travel within the slot 32 between one slot end abutment 31 and the opposing slot end abutment 31 during operation of the latch 20, as further described below. As discussed, movement of the bearing 22 within the slot 32 (e.g. between the slot end abutments 31) can be provided for as predominantly rolling movement, i.e. the bearing 22 is free to rotate within the cage 29 as the bearing 22 moves along surfaces 34,36—see FIGS. 10, 11, 12—thereby having the exterior surface of the bearing 22 predominantly experience rolling friction with respect to the surfaces 34,36. It is also recognized that the bearing 22 can translate along surface(s) 34,36 predominantly by sliding see—FIG. 13—thereby having the exterior surface of the bearing 22 predominantly experience sliding friction with respect to the surfaces 34,36. An example of rolling/rotating movement of the bearing 22 can be when the bearing 22 is traveling between slot end abutments 31 of the slots 32. An example of translational (i.e. sliding rather than rotating) movement of the bearing 22 can be when the bearing 22 is positioned against one of the slot end abutments 31, in other words constrained from further movement along the length of the slot 32 by contact with one of the slot end abutments 31. It is recognized that the slot end abutments 31 can be positioned at the physical end of the slot 32 length or can be positioned adjacent to the physical end of the slot 32 length, as desired.

As such, the ball bearing 22 can have one or more points (also referred to as localized region) of contact between the exterior surface of the ball bearing 22 and each of the surfaces 34,36, such that for two or more points (e.g. plurality) of contact with a respective surface 34,36, each of the two or more points of contact on the same surface 34,36 are separated (i.e. distanced along the exterior surface of the ball bearing 22 and therefore not considered as a line of contact) from one another. It is recognized that the point(s) of contact experienced by the ball bearing 22 are different from a line of contact provided by a roller bearing. As such, it is recognized that contact between a roller bearing (e.g. cylindrical bearing) and an adjacent surface is comprised of a series of connected contact regions in the form of the line, which is different from a localized point or region of contact between the adjacent surface 34,36 and the ball bearing 22 (e.g. spherical bearing). It is also recognized that a roller bearing has a single dedicated or fixed/consistent axis of rotation along the length of the cylinder while the ball bearing 22 can have multiple different axes of rotation as the ball bearing 22 repositions itself within the cage 29, as the ball bearing 22 rotates during contact with the surfaces 34,36 as the ratchet 24 and pawl 25 rotate about their shafts 28,26, For example, ball bearings 22 make use of hardened spherical balls that can handle both radial as well as thrust loads. Because the ball bearings 22 are spherical, there is very small area or localized (e.g., point) of contact with the adjacent surface 34,36 and the exterior surface of the ball bearing 22, Thus it is recognized that when the load is high between the surfaces, the exterior surface of the ball bearings 22 can get deformed (e.g. localized flattening at the point of contact).

in comparison, roller bearings are used in applications where large load is to be borne, for example in conveyor belts where rollers must bear heavy radial loads. As the name implies, the roller is not a sphere but cylindrical in shape so that contact between the outer surface of the roller and an adjacent surface is not a point but a straight line. Thus there is a greater contact than ball bearings 22 and the load is spread out over a larger area allowing roller bearings to bear a heavier loads than ball bearings 22. One variation of roller bearings is known as needle bearings where the diameter of the cylinders is very small.

As such, in the case of ball bearings 22, the bearings are hardened spherical balls that can greatly reduce the friction between moving parts (i.e. ratchet 24 and pawl 25) as the area of contact is a point (or localized region) only. It is recognized that a line contact of the roller bearing is a distributed area of contact, which is considered substantively different from a point which is a localized region of contact. It is also recognized that a roller bearing has a dedicated or fixed axis of rotation along the length of the cylinder employed during rotation of the cylindrical bearing, as compared to the ball bearing 22 which has a dynamic or changing axis of rotation during rotation as the ball bearing 22 is free to change the orientation of the axis of rotation within the cage 29 due to frictional and load forces generated between the exterior surface of the ball bearing and the surface(s) 34,36. In other words, the portion of the exterior surface of the ball bearing 22 in contact with the slots 32 is free to vary during rotation, as compared to the roller bearing whereby the portion of the exterior surface of the roller bearing in contact with the roller guides is fixed (i.e. does not vary) during rotation.

Referring again to FIG. 2, an abutment surface 38 of the sidewalls 30 abuts guide surface 41 positioned on the ratchet 24 in order to guide positioning of the ball bearing 22 with respect to the surface(s) 34,36 as the pawl 25 and ratchet 24 co-rotate between the open and closed positions of the latch 20. As shown, the guide surface 41 can be of arcuate shape. As an example, the abutment surfaces 38,41 of both the pawl 25 and ratchet 24 can be arcuate with centers of curvature coinciding with the pawl 24 center of rotation.

The bearing 22 can be of a general cylindrical shape (e.g. cylindroid) or can be of a general spheroidal shape, recognizing that the surface 80 (see FIG. 9) of the bearing 22 is of arcuate shape (i.e. convex shape bulging outward from a center or centroid of the bearing 22). It is also recognized that the bearing 22 can be a combination of cylindroid and spheroid, see FIG. 20, as desired. As such, the bearing 22 as a spheroid has the surface 80 defined as an approximately spherical body, admitting irregularities even beyond the bi- or tri-axial ellipsoidal shape defining a quadric surface obtained by rotating an ellipse about one of its principal axes; in other words, an ellipsoid (also referred to as spheroid) with two equal semi-diameters. It is recognized that a spherical shape of the surface 80 is an embodiment of the spheroidal shape, such that the surface 80 is defined as a set of points that are all at the same distance r from a given center of the bearing 22. As such, the bearing 22 as a spheroid can be defined as having a general spherical shape in which the surface 80 is defined as a set of points in which not all at the same distance r from a given center of the bearing 22. In terms of the cylindroid shape of the surface 80, this shape can be defined as a cylinder having an ellipse as its cross section taken along a rotational axis of the bearing 22. It is recognized that a cylindrical shape of the surface 80 is an embodiment of the cylindroid shape, such that the arcuate (e.g. convex) surface 80 is defined as a set of points that are all at the same distance r from a given central axis (i.e. rotational axis) of the bearing 22. As such, the bearing 22 as a cylindroid can be defined as having a general cylindrical shape in which the arcuate surface 80 is defined as a set of points in which not all are at the same distance r from the given central axis of the bearing 22. In terms of the cylindroid bearing 22 embodiment, the arcuate surface 80 rotates about a defined and consistent central axis during rotation between surfaces 34,36. In terms of the spheroidal bearing 22 embodiment, the arcuate surface 80 rotates about a central point and therefore has a dynamically changing axis of rotation during rotation between surfaces 34,36.

In terms of the spheroidal bearing 22 embodiment, the arcuate surface 80 contacts the surface 34 at a contact region 82 (e.g. a point or other localized finite surface area) and the surface 36 at a contact region 84 (e.g. a point or other localized finite surface area), shown in ghosted view in FIG. 3, such that a width of the contact region 82 is less than a width Wp of the pawl 25 (e.g. less than the width of the contact or cam surface 34) and a width of the contact region 84 is less than a width Wr of the ratchet 24 (e.g. less than the width of the contact or cam surface 36). It is recognized that the contact regions 82, 84 are a portion of the spheroidal surface 80. It is also recognized that the measured width (e.g. diameter) of the bearing 22 extending between the sidewalls 30 of the cage 29 can be greater than or less than the width (Wp) of the body of the pawl 25 and/or the width (Wr) of the body of the ratchet 24, as long as the surface 80 of the bearing is contained by the sidewalls 30 within the opposed slots 32. Shown by example is where the width of the bearing 22 is greater than both the width Wp of the pawl 25 body and the width Wr of the ratchet 24 body (e.g. the widths of the contact or cam surfaces 34,36 respectively). Further, the width of the contact regions 82,84 are less than the measured width of the bearing 22 with respect to the sidewalls 30. It is recognized that in the case where the sidewalls 30 (see FIG. 2) hold the bearing 22 such that contact between the arcuate surface 80 and the surface 34 is inhibited, contact region 82 would be optional. Further, in the case where the sidewalls 30 (see FIG. 2 for example) when mounted on the ratchet 24 hold the bearing 22 such that contact between the arcuate surface 80 and the surface 36 is inhibited, contact region 84 would be optional. See FIGS. 21,22 for an example where the cage 29 is mounted on a body of the ratchet 24, recognizing that the sidewalls 30 can contain the slot 32 that provides a fixed mounting location of the bearing 22 providing a fixed location axis of rotation (see FIGS. 21, 22), or can provide a variable mounting location of the bearing providing a variable positioned axis of rotation (see FIGS. 1-19).

Further, it is recognized that the contact regions 82,84 can be defined as a a spheroidal sector (i.e. a portion of the spheroidal surface 80) defined by a conical boundary with apex at the center of the spheroid. The spheroidal sector (i.e. contact region 82,84) can be described as a union of a spheroidal cap and a cone formed by a center (or centroid) of the spheroid and a base of the cap. For example, if the radius of the spheroid (e.g. sphere) is denoted by r and the height of the cap by h, the surface area of the spheroidal (e.g. spherical) sector is 2(Pi)rh. It is recognized that for a spheroid, the radius r may be an average radius of all points defining the arcuate surface 80 and the height h may be an average height for all points of the cone on the arcuate surface 80.

Figure 6A:
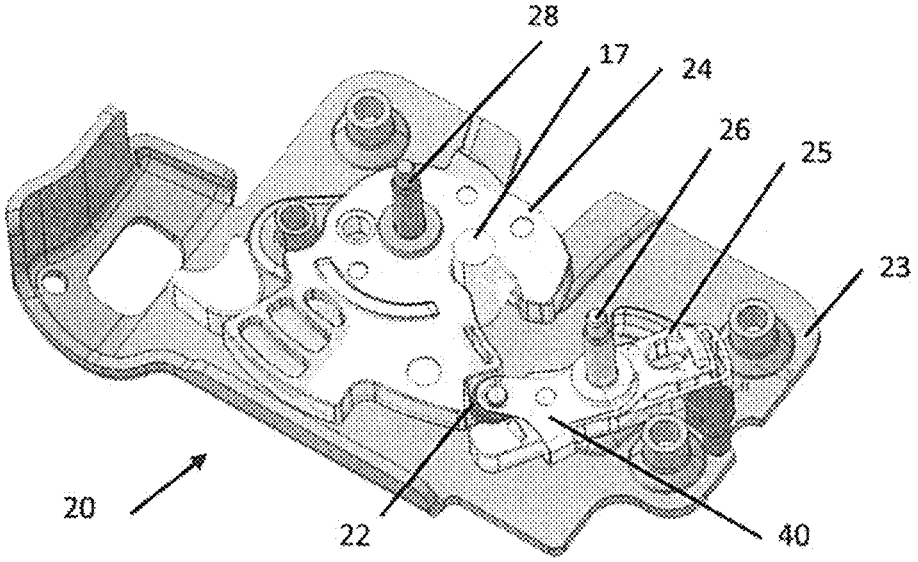
Figure 6B:
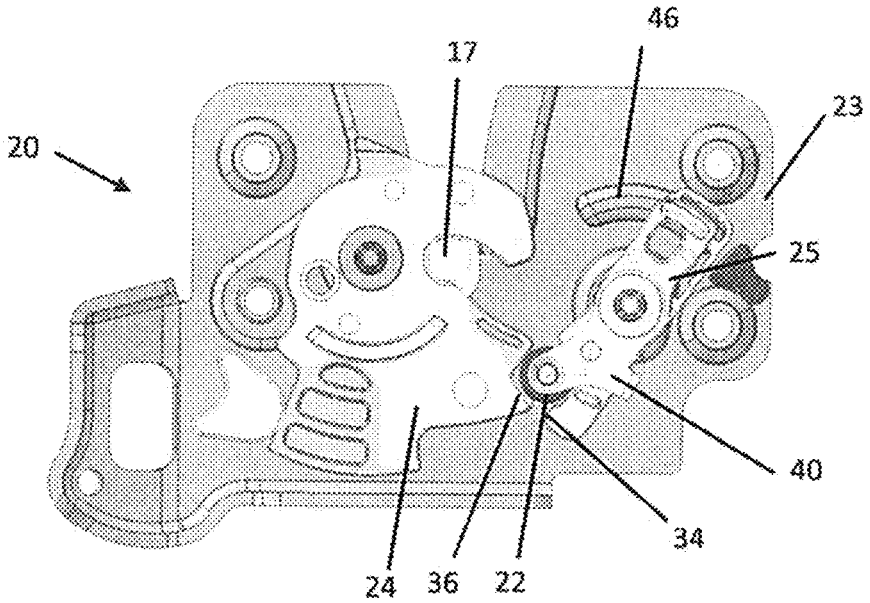
Figure 6C:
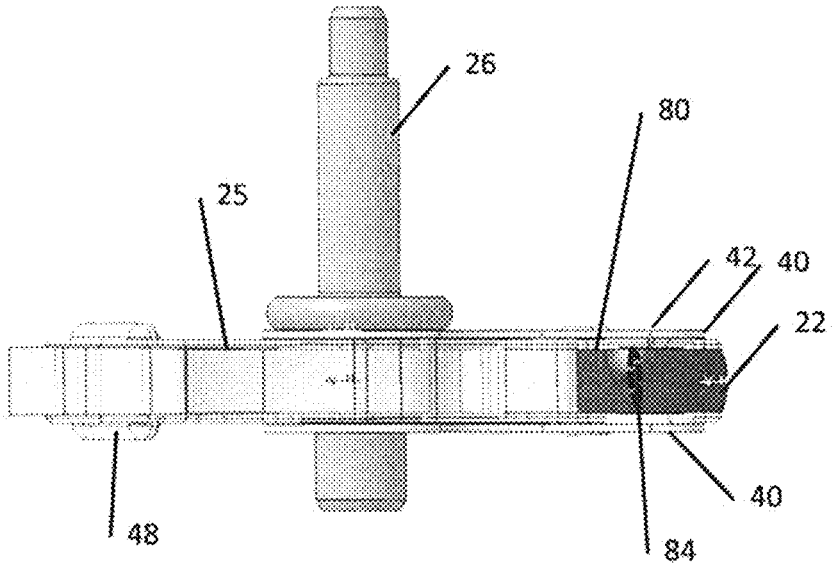
Figure 6D:
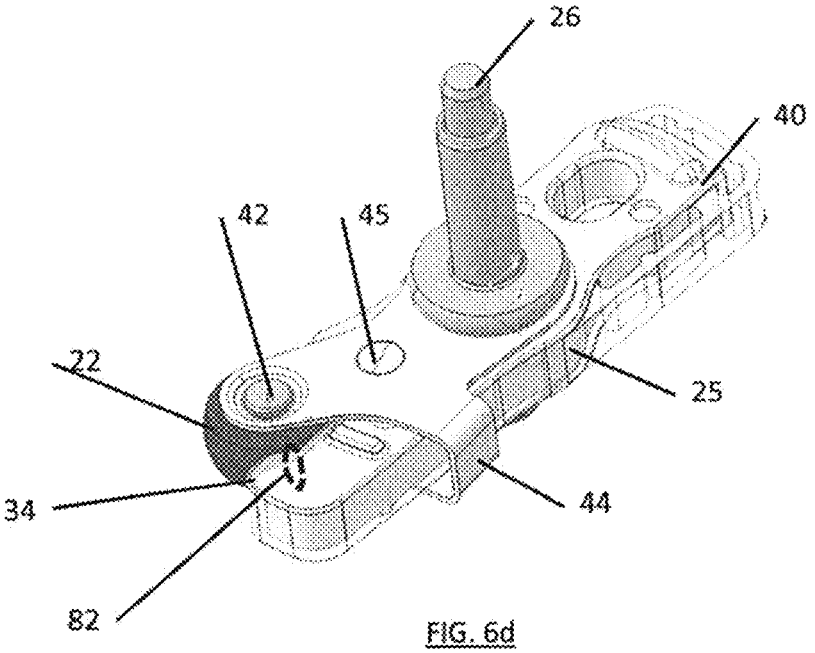

In terms of the cylindroid bearing 22 embodiment, the arcuate surface 80 (see FIGS. 6*a, b, c, d*) contacts the surface 34 at a contact region 82 (e.g. a line or other elongated finite surface area) and the surface 36 at a contact region 84 (e.g. a line or other elongated finite surface area), shown in ghosted view in FIGS. 6*c, d,* such that a width of the contact region 82 is the same as the width Wp of the pawl 25 (e.g. the width of the contact or cam surface 34) and a width of the contact region 84 is the same as the width Wr of the ratchet 24 (e.g. the width of the contact or cam surface 36). It is recognized that the contact regions 82, 84 are a portion of the cylindroid surface 80 in contact with the surfaces 34,36, extending between one side of the bearing 22 and the other side of the bearing 22 as measured along the central rotational axis of the bearing 22. It is recognized that the rotational axis of the bearing 22 may be longer than the widths Wp, Wr. It is also recognized that the measured width (e.g. length) of the bearing 22 extending between the sidewalls 30 of the cage 29 can be greater than or less than the width (Wp) of the body of the pawl 25 and/or the width (Wr) of the body of the ratchet 24, as long as the surface 80 of the bearing is contained by the sidewalls 30 within the opposed slots 32. Shown by example is where the width of the bearing 22 is greater than both the width Wp of the pawl 25 body and the width Wr of the ratchet 24 body. It is recognized that in the case where the arms 40 (see FIG. 6*c*) hold the bearing 22 such that contact between the arcuate surface 80 and the surface 34 is inhibited, contact region 82 would be optional. Further, in the case where the arms 40 (see FIG. 6*c* for example) when mounted on the ratchet 24 hold the bearing 22 such that contact between the arcuate surface 80 and the surface 36 is inhibited, contact region 84 would be optional.

It is also recognized that the bearing 22 as a cylindroid (e.g. cylinder) can be mounted in the cage 29, whereby at least a portion of the surface 80 has mounted (or formed) thereon an exterior surface 80 defined as having character as spheroidal (e.g. spherical). As such, it is recognized that even the bearing 22 having a cylindrical/cylindroid main body 88 can have a portion of the exterior arcuate surface 80 being spheroidal (e.g. spherical) 90, see FIG. 20, such that the spheroidal surface 90 contains the contact regions 82,84 as discussed above.

Referring to FIG. 9, shown is the bearing 22 positioned between surfaces 34,36 when the latch 20 is in the initial primary latched position, such that the mating latch component 17 is retained by the slot 23 of the ratchet 24. Not shown is the cage 29 for purposes of illustration only, however recognizing that in FIG. 9 the bearing 22 can be positioned at the one slot end abutment 31 (e.g. slot end abutment 31 furthest from the surface 36 of the ratchet 24), as shown in FIG. 19, when the pawl 25 is in the initial latched position. Also shown is an arcuate guide surface 92 on the housing 20*a* for guiding the bearing 22 between the ratchet 24 and the pawl 25 when in operation, in case the bearing 22 becomes detached from the cage 29 (see FIG. 2).

As such, the bearing 22 follows the arcuate guide surface 92 as driven by the pawl 25 (when the bearing 22 becomes detached from the cage 29) as the radius of the arcuate guide surface 92 follows the traveling extent of the pawl 25. Also shown in FIG. 9 are one or more resilient bumpers 96 positioned on the surfaces 34,36 in order to provide for noise dampening of the bearing 22 when coming into contact with the surfaces 34,36.

Figure 10:
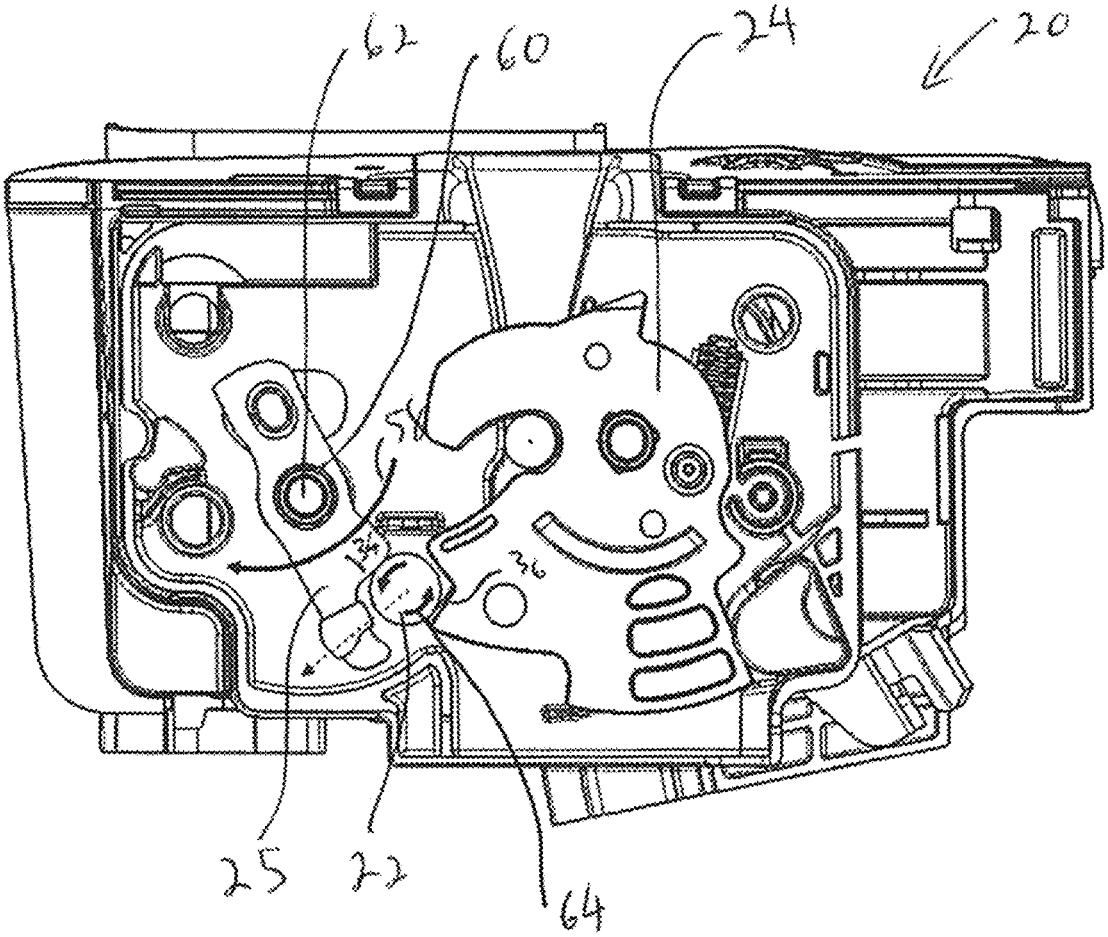

Referring to FIG. 10, as the pawl 25 is actively released (e.g. rotated 58 against bias of a pawl return biasing element 60 about pawl pivot axis 62), the bearing 22 is free to rotate 64 within the cage 29 (see FIG. 2) and thus the exterior surface of the bearing 22 can experience rolling friction again the surfaces 34,36 of the pawl 25 and the ratchet 24 respectively. It is recognized that during rotation the bearing 22 can be located in the slots 32 away from both of the opposed slot end abutments 31, i.e. the bearing 22 is in the process of travelling from one end 31 of the slot 32 (e.g. slot end abutment 31 furthest from the surface 36 of the ratchet 24) to the other and 31 (e.g. slot end abutment 31 closest to the surface 36 of the ratchet 24) of the slot 32. Not shown is the cage 29 for purposes of illustration only.

Figure 11:
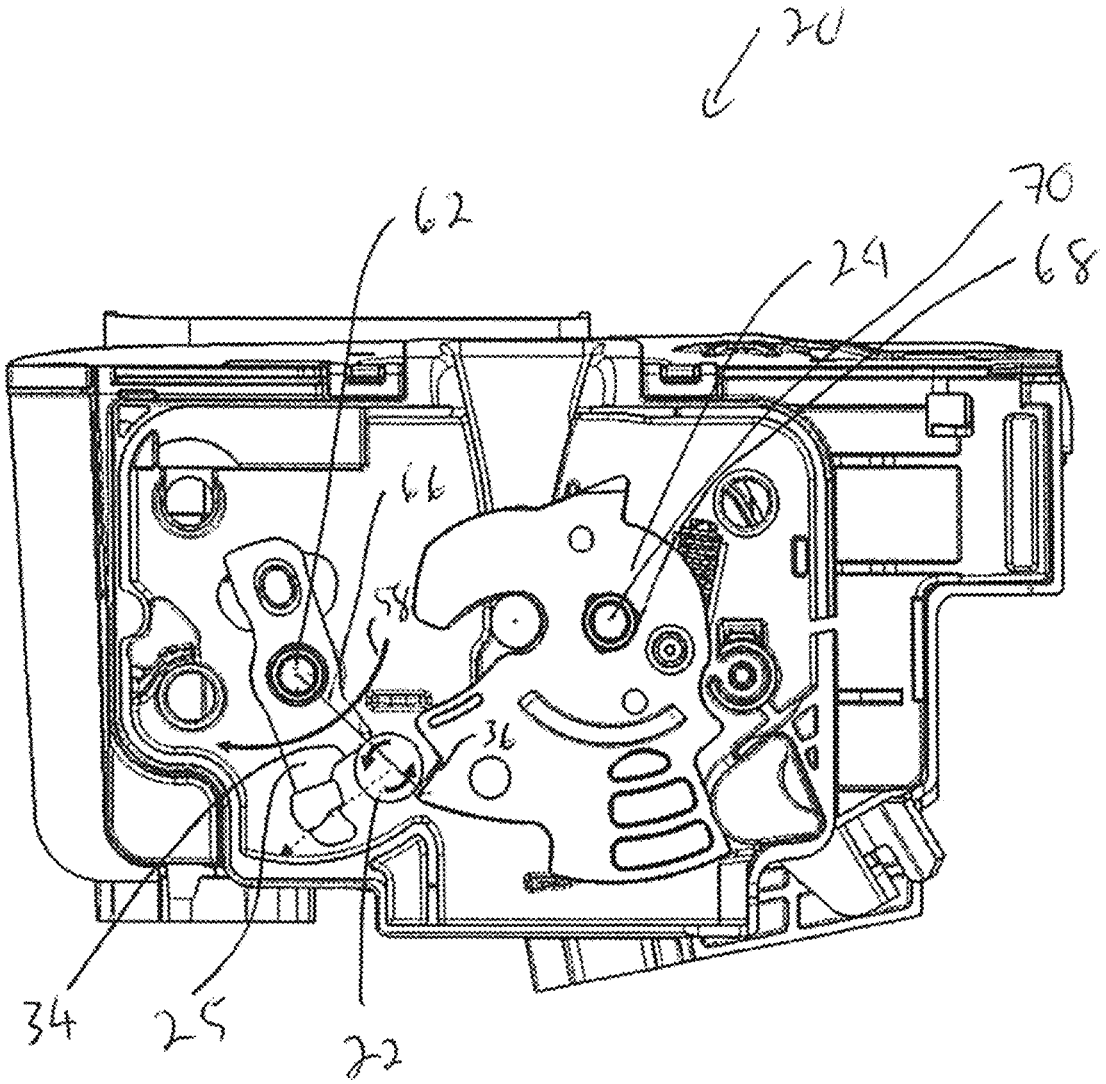
Figure 12:
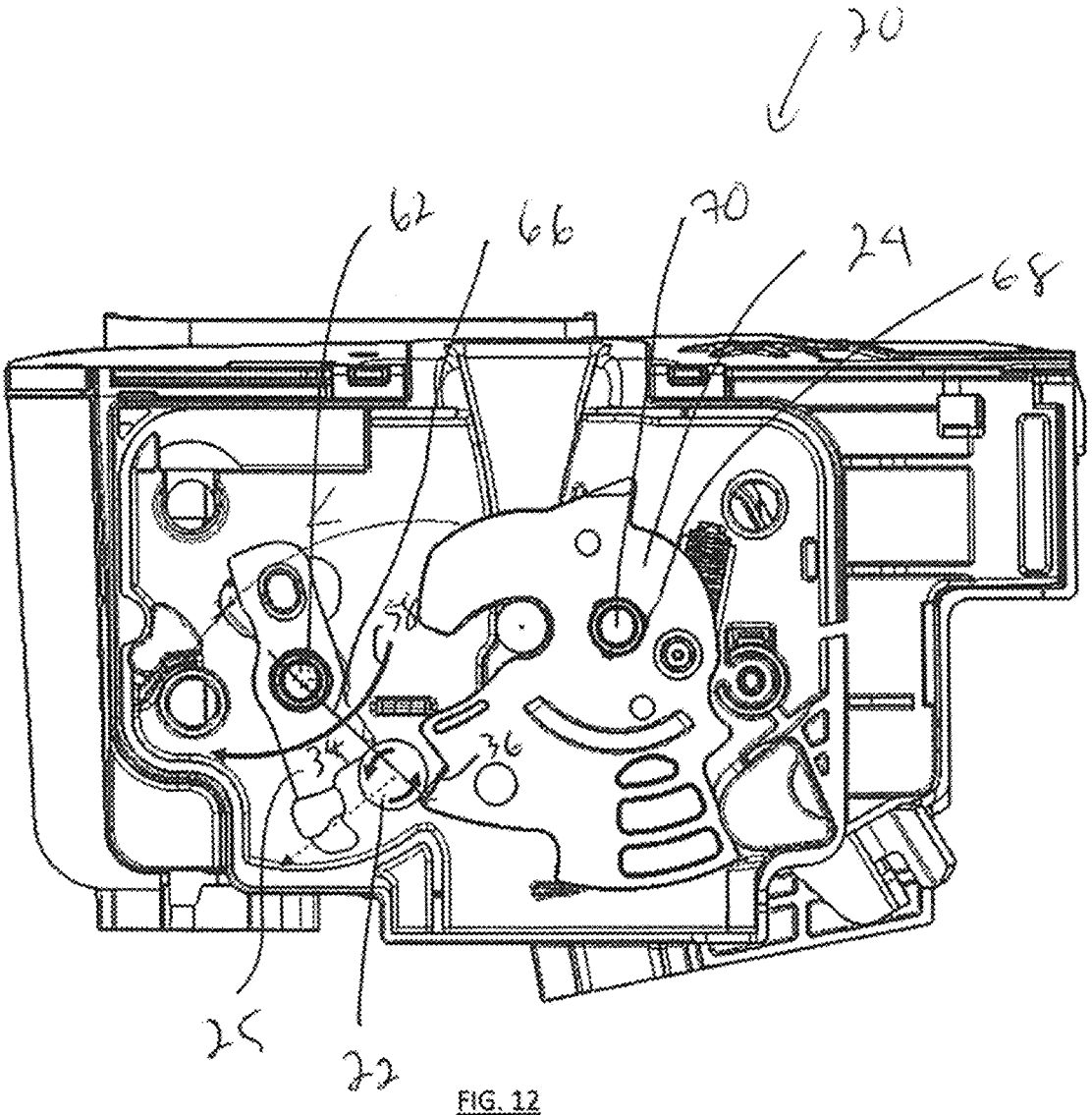
Figure 13:
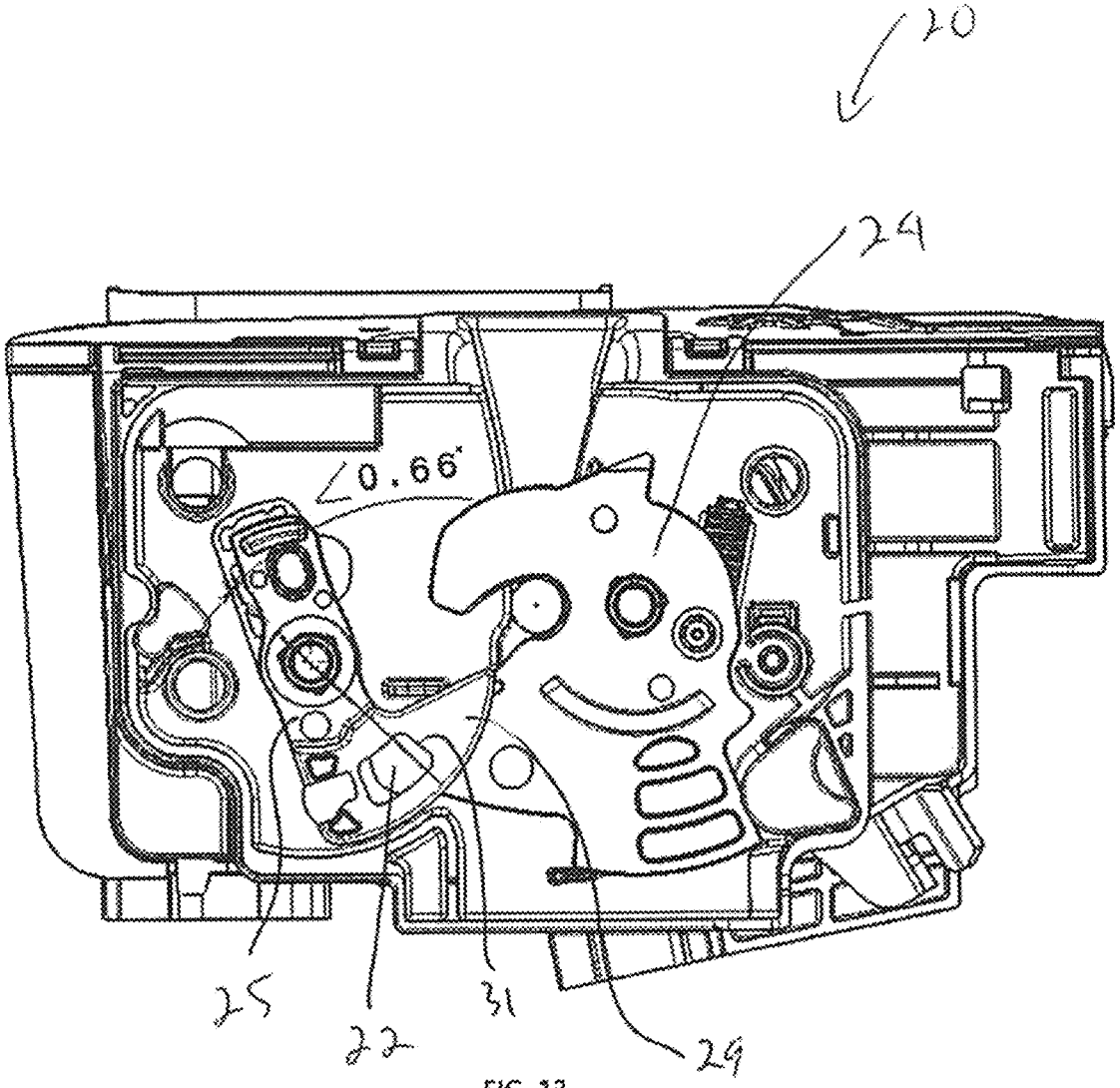

Referring to FIG. 11, shown is where a normal force 66 acts between the surfaces 34,36 and through the bearing 22, as directed from the pawl pivot axis 62. Further rotation 58 of the pawl 25, as shown in FIG. 12, causes the normal force 66 to drift away from the center of the pawl 25 pivot (Le. the pivot axis 62), thereby proving a release moment of the ratchet 24, such that the ratchet 24 is free to rotate away from the pawl under influence of the ratchet biasing element 68 (e.g. spring) about pivot axis 70. It is noted that at this point the bearing 22 can still be located between the opposed slot end abutments 31 and thus still travelling along the length 33 (see FIG. 4*a*) of the slots 32. Not shown is the cage 29 for purposes of illustration only. Alternatively, at this point the bearing 22 can be located at the slot end abutment 31 closest to the ratchet 24, as shown in FIG. 13. It is recognized that the function of the slot 32 on the pawl 25 (including the bearing cage 29) can be to guide the travel path of the bearing 22 along the length 33 (see FIG. 4*a* and FIG. 16) between the slot end abutments 31, and thus to constrain the bearing 22 movement as described during rotation of the pawl 25 and ultimate release and resultant rotation of the ratchet 24. Referring again to FIGS. 2 and 4*a*, shown is a secondary position of the ratchet 24 at cam surface 37, as compared to the primary position shown at cam surface 36. In other words, primary latch 20 close is when the bearing 22 is positioned between surfaces 34,36 and secondary latch 20 close is when the bearing 22 is positioned between surfaces 34,37.

Referring again to FIG. 12, the contact surfaces 34,36 can be considered cam surfaces having a neutral, forward or back angle as measured radially from the respective pivot points 62,70. For example, one embodiment is where the cam surface 34 and/or the cam surface 36 is provided as having a neutral angle, such that the force required to roll and/or slide the bearing 22 off of the cam surface 34,36 is less that that required for a back angle orientation of the cam surface(s) 34,36. Accordingly, it is recognized that a back angle provided on a cam surface(s) 34,36 requires force to encourage movement of the bearing 22 along the surface 34,36. This is compared to a forward angle provided on a cam surface(s) 34,36, which may not require force to encourage movement of the bearing 22 along the surface 34,36, It is recognized that the combination of surfaces 34,36 in contact with the bearing 22 provides for a relative measurement of the cam surface angle with respect to one another.

Referring to FIG. 14, after the normal force 66 directed through the bearing 22 has passed a tangent to tangent point (i.e. the normal force 66 has moved off center of the pivot axis 60), travel of the exterior surface of the bearing 22 along the surfaces 34,36 can change from predominantly rotation to translation, thus causing sliding friction 72 to be experienced between the exterior surface of the bearing 22 and the surfaces 34,36, Referring to FIG. 15, once the pawl 25 has been released from the ratchet 24, i.e. bearing 22 loses contact with surface 36, the bearing 22 can travel back along the length 33 of the slots 32 (see FIG. 4*a*) when travelling away from the slot end abutment 31 adjacent to the surface 36 and towards slot end abutment 31 adjacent to surface 34. Preferably once the pawl 25 is released, the bearing 22 will come back into contact with the surfaces 34 of the pawl 25. For example, the bearing 22 can come into contact with rest position abutment 74 positioned on a rest face 34 of the pawl 25.

Referring to FIG. 16, it is recognized that as the ratchet 24 is rotating 76 about pivot axis 70, in order to release the latch mating component 17 from the slots 13,23 (proving for the latch 20 to be placed into the open position—for example secondary position), the bearing can travel freely back and forth in the slots 32 between the slot end abutments 31, shown in ghosted view. Referring to FIG. 17, shown is the bearing 22 contained in cage 29 while the bearing 22 has lost contact with surface 36 of the ratchet 24.

Referring to FIG. 18, shown is when the ratchet 24 is completely open and thus the latch mating component 17 has been released from the slot 23 of the ratchet 24 and positioned for unrestrained travel in the slot 13 of the latch 20. It is recognized that travel of the ratchet 24 provides for movement of a rest surface 78 to move past the location of the bearing 22 and to become positioned opposite to the bearing 22. As shown in FIG. 19, once the biasing element 60 of the pawl 25 is allowed to drive the pawl 25, the pawl rotates 80 about pivot axis 60 and the bearing 22 contacts the rest surface 80, this positioning the bearing 22 in the slot 32 against the slot end abutment 31 adjacent to the surface 34 (see FIG. 15). Accordingly, the pawl 25 is now positioned in the home position by the biasing element 62. Subsequent rotation of the ratchet 24 about pivot axis 70 against biasing element 68 will cause the bearing 22 to travel along rest surface 80 and back into engagement with surface 36, see FIG. 9, thus returning the latch 20 from the open position to the primary latched position.

It is also recognized that an alternative embodiment of the latch 20 is where the cage 29 and enclosed ball bearing 22 is mounted (not shown) to a body of the ratchet 24. As such, the ball bearing 22 would be positioned similarly as for the embodiment of FIG. 2, i.e. between the adjacent surfaces 34,36. The abutment surface 40 of the ratchet 24 is arcuate and can be of an arcuate profile to facilitate a gradual release of the pawl 25 to inhibit pop oft noise. It is recognized that the bearing positioned at secondary cam surface 37 is optional (see FIGS. 21,22).

The latch components can include a number of biasing elements (for example springs), such as ratchet biasing element 68 that biases rotation of the ratchet 24 about the shaft 28 to drive the mating latch component 17 out of the slot 13 (thus moving the closure panel 16 towards the open position), and pawl biasing element 60 that biases rotation of the pawl 25 about the shaft 26 to retain the ratchet 24 in the closed position (i.e. restrict rotation of the ratchet 24 about the shaft 28 under the influence of the ratchet biasing element). In terms of cooperation of the various latch components with one another, a plurality of detents (also referred to as shoulder stops) can be employed to retain the latch components in position until acted upon. For example, the ratchet 25 can have one or more detents (or shoulder stops) that mate with detent(s) (or shoulder stops) of the ratchet 24, via the ball bearing 22, thus retaining the ratchet 24 in the closed position.

Referring to FIG. 5, shown are example latch 20 dimensions.

In view of the above and below presented embodiments of the latch 20, for example, features of the embodiments can include: bearing 22 for facilitating reductions in release effort as described; lower closing noise as compared to surface to surface 34,36 predominantly sliding contact; custom component sizing for ratchet 24 and pawl 25 based on geometry of the housing 20*a* and bearing 22; preferable inertial loading capacity along with mounting points of the housing 20*a* determined by design; a balanced pawl 25 facilitating lower relative noise lock/unlock with or without power release; lower relative mass of latch components (e.g. pawl 25 and ratchet 24) with bearing 22 inclusion as compared to non-bearing latch designs due to the presence of rolling contact in the latch 20; can be utilized in a vertical double lock child lock or other SMA power release actuator (see controller 12 of FIG. 1); flexible cable routing along with printed circuit board traces; magnetic stop bumpers; and/or spring loaded bumpers as desired.

Characteristics of the latch 20 embodiments described can include: 1) using bearing 22 on ratchet 24 (fork) and/or pawl 25 (detent); 2) using bearing 22 inside primary or auxiliary door latch 20 design to facilitate reduced release effort as compared to direct engagement of pawl 25 and ratchet 24 abutment surfaces 34,36; 3) slot 32 design on pawl (detent) encapsulation of the cage 29 or use of arm(s) 40 with pin 42 to keep the bearing 22 positioned between the surfaces 34,36 as well as to facilitate rotation of the bearing 22 in position during rotation of the latch components (e.g. pawl 25 and ratchet 24); 4) ratchet 24 (folk) primary and secondary profile for any usage of sphere/cylinder share contact; 5) using the bearing 22 inhibits issues of alignment between catch and detent (multi-planar ability); 6) manipulating the bearing 22 location and the catch tooth profile to can reduce energy release (pop-off) noise; and 7) improved load bearing and reduced wear capacity provided by bearing 22 and surface 34,36 contact.

Example design examples of the ball bearing 22 can include: fit optimal gold cube package; 8.0 mm hardened ball instead of roller; ease of assembly due to facilitation of alignment via cage 29 and ball bearing 22 assembly; and/or use of harder plastic (PPA 30GF) for 2nd mold encapsulation. Similarly, example design examples of a roller bearing 22 (see FIGS. 6*a*, 7*a*, 8*a*) can include: hardened roller instead of ball; ease of assembly due to facilitation of alignment via arm(s) 40 (e.g., acting as a cage) and bearing 22 assembly; and/or use of harder plastic (PPA 30GF) for 2nd mold encapsulation.

Referring to FIGS. 6*a*, 6*b*, shown is a further embodiment of the latch 20 including a number of latch elements (e.g. the ratchet 24, the roller bearing 22 and the pawl 25) that are configured to cooperate with the mating latch component 17 in order to retain the mating latch component 17 within the slot 13 when the closure panel 16 (see FIG. 1) is in the closed position (e.g. locked), or otherwise to drive the mating latch component 17 out of the slot 13 when the closure panel 16 is in the open position. The latch elements of the ratchet 24 and pawl 25 are pivotally secured to the frame plate 23 via respective shafts or pins 28,26. For example, using a hardened roller bearing 22 between the ratchet 24 and pawl 25 can facilitate an engagement contact change from directly between the adjacent surfaces 34,36 to a desired line contact (i.e. rolling contact between the exterior surface of the roller bearing 22 and the surfaces 34,36) with rolling friction less than what would be exhibited by sliding friction due to direct contact between the surfaces 34,36 (i.e. when no roller bearing 22 is positioned between the surfaces 34,36).

It is recognized that roller bearing 22 of FIG. 6*a*, 6*b*, 6*c* can be substituted for ball bearing 22 shown in FIGS. 9-19, such that the sides (e.g. mounting pin 42) of the roller bearing 22 cooperate with slots 32 in arm(s) 40 (similar to the sidewall(s) 30 of FIG. 2) so as to guide the roller bearing 22 from one slot end abutment 31 to the other slot end abutment 31, as the pawl 25 is rotated 58. For simplicity, the term arm(s) 40 can refer to sidewall(s) 30 or vice versa. As such, the cage 29 can be composed of one or multiple (e.g. two) arm(s) 40 or sidewall(s) 30 and the mounting of the bearing 22 to the arm(s) 40/sidewall(s) 30 can be via the slot 32 (for both the spheroid or cylindroid shaped bearing 22) and/or the mounting pin 42 (for the cylindroid bearing 22). As such, it is recognized that the mounting pin 42 can be slidably received within the slots 32 positioned on either side of the roller bearing 22, as desired. As such, the roller bearing 22 can experience both sliding friction and rolling friction similar to the bail bearing 22 shown and described by example in FIGS. 9-19.

Referring to FIG. 6*c*, shown is a pair of arms 40 (also referred to as sidewall(s) 30 in FIG. 2) attached to either side of the pawl 25 (e.g. at shaft 26) for holding the roller bearing 22. The roller bearing 22 is positioned between the arms 40 and mounted thereto by a mounting pin 42 acting as a fixed axis of rotation for the roller bearing 22, the mounting pin 42 projecting between the pair of arms 40 on either side of the body of the pawl 25. The arms 40 can be optionally connected directly to one another by a connection member 44 that is separate from the pin 26 and body of the pawl 25. For example, the arms 40 can be connected to the body of the pawl 25 by a connector 45 (e.g. screw) that is separate from the pin 26. Similar to the preceding embodiments referred to in FIGS. 1 to 5, the roller bearing 22 in the alternative embodiments of FIGS. 6*a*, 7*a*, 8*a* can be positioned such that the roller bearing 22 can have a plurality of contacts between an exterior surface of the roller bearing 22 and the surface(s) 34,36.

For example, the surface(s) 34,36 can be of an arcuate (e.g. concave) or angled shape (e.g. L shaped) to facilitate retaining of the roller bearing 22 between the surfaces 34,36 when the latch is in the closed position (see FIG. 6*b*). As such the surface 34 of the pawl 25 can act as a cradle for the roller bearing 22 in order to support the bearing 22 and facilitate alignment of the roller bearing 22 in a desired orientation between the arms 40 (or extending from a single arm 40 as per FIG. 8*a*). Further, the arrangement of the pin 42 and arm(s) 40 can be referred to as a cage to orient contact of the roller bearing 22 to have a plurality of contacts with the surface 34 of the pawl 25 and/or the surface 36 of the ratchet 24, An advantage of using the arm(s) 40, pin 42 and roller bearing 22 arrangement to address friction levels between the ratchet 24 and the pawl 25 contact is that the dimensional characteristics of the arm(s) 40, the pin 42 and/or the roller bearing 22 can be varied to match different dimensions/orientations/positioning of various ratchet/pawl designs. As such the use of the arm(s) 40, pin 42 and roller bearing 22 arrangement can be easily adapted for different configurations of ratchet/pawl for encountered in various latch 20 configurations.

Figure 7A:
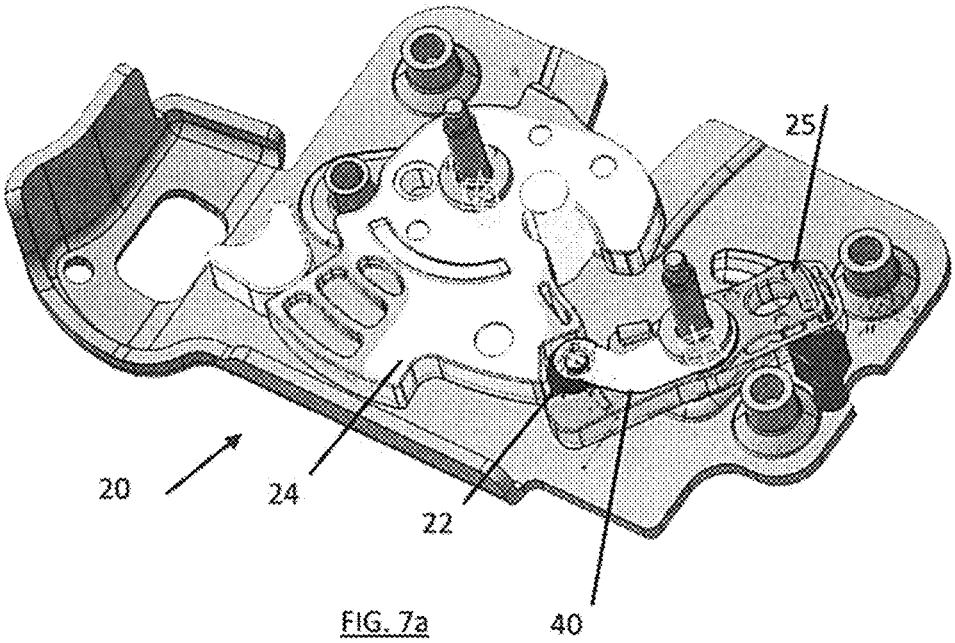
Figure 7B:
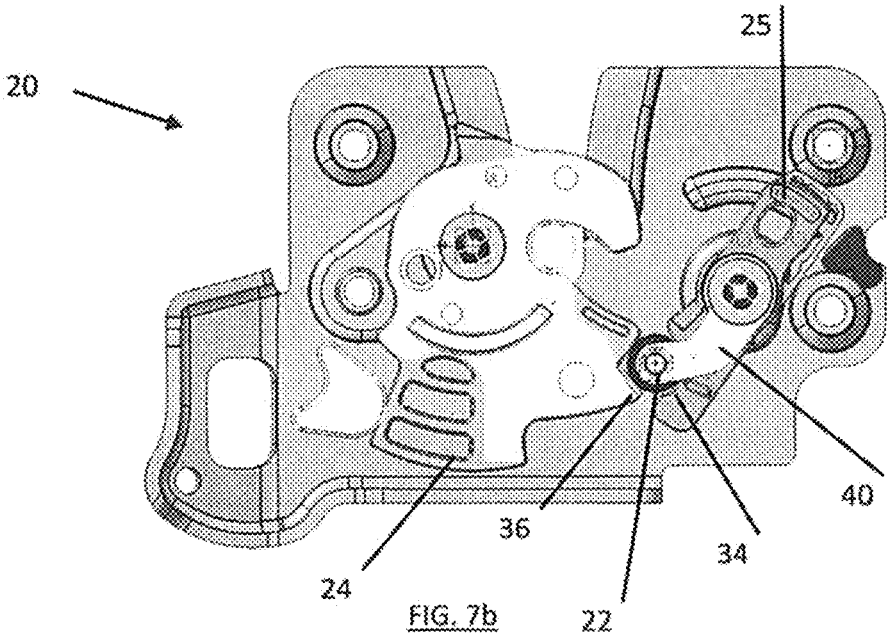
Figure 7C:
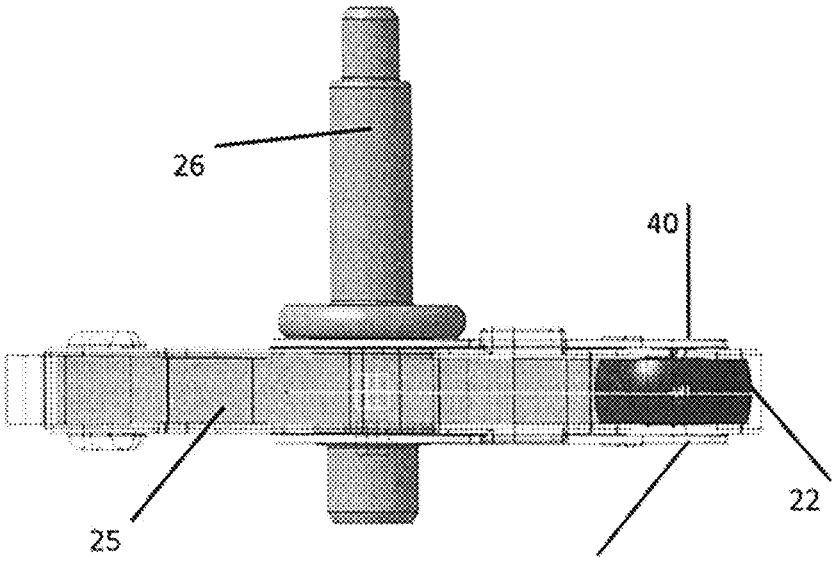
Figure 7D:
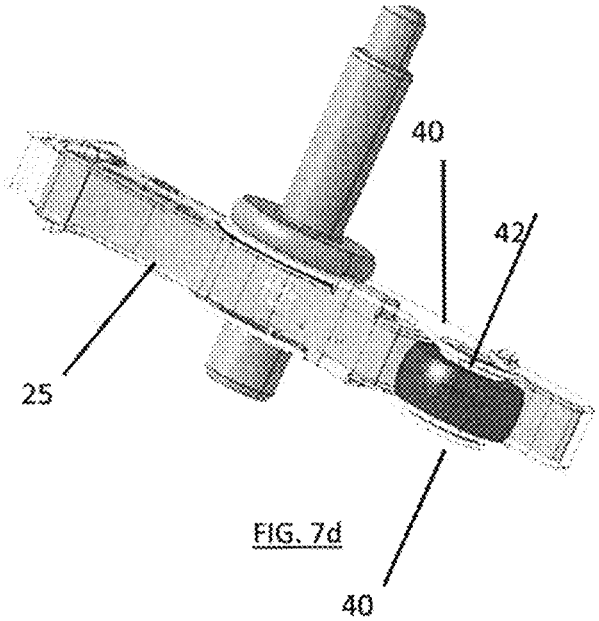
Figure 8A:
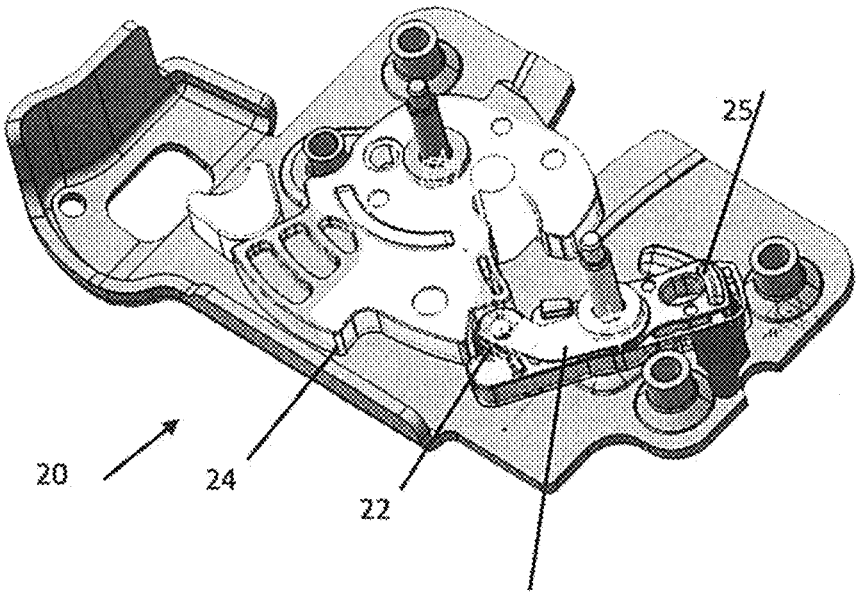
Figure 8B:
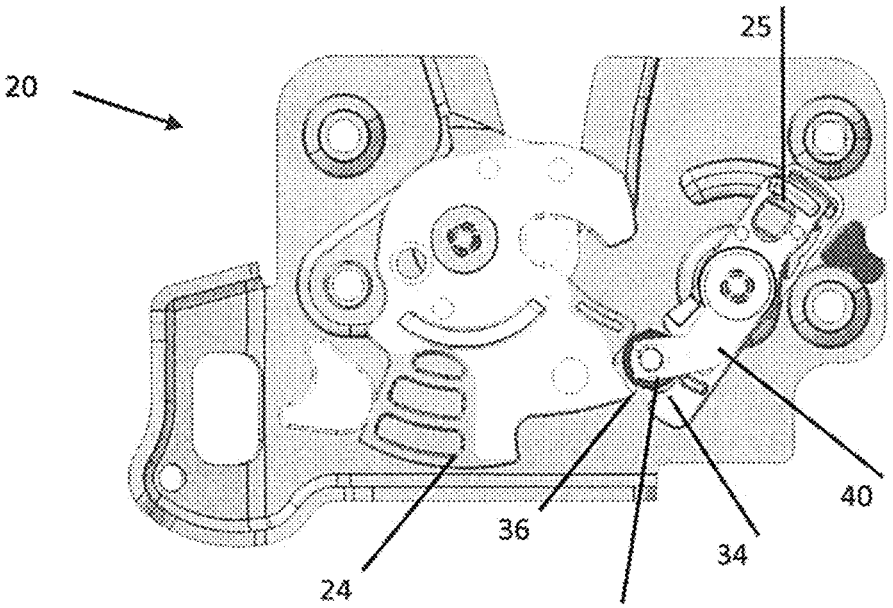
Figure 8C:
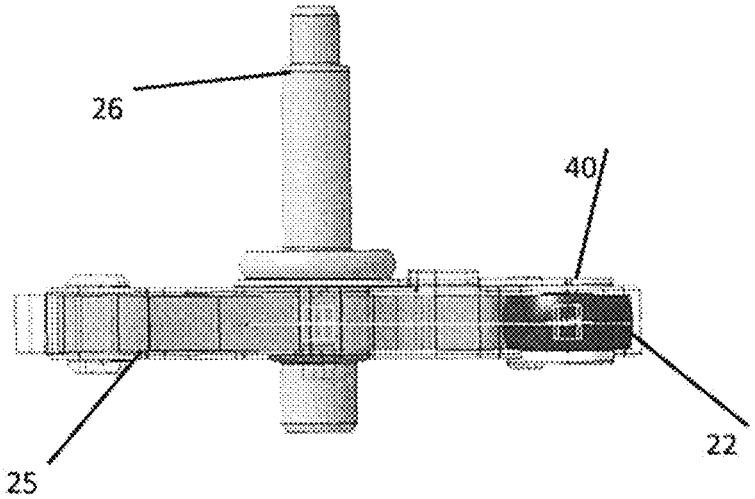
Figure 8D:
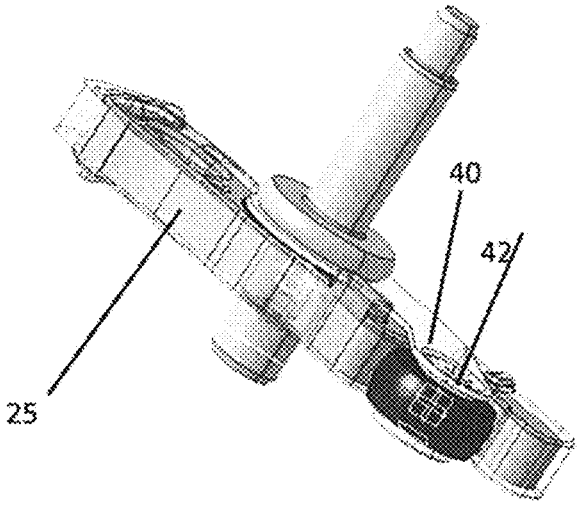

In terms of the embodiments of FIGS. 6*a*, 7*a*, 8*a*, it is recognized that the roller bearing 22 can be a roller bearing such that the plurality of contacts experienced by the bearing 22 are lines of contact provided. As such, it is recognized that contact between a roller bearing (e.g. cylindrical bearing) and an adjacent surface 34,36 is comprised of a series of connected contact regions in the form of a line, which is different from a localized point or region of contact between the adjacent surface 34,36 and the ball bearing 22 (e.g. spherical bearing) shown in FIGS. 1-5. It is also recognized that the roller bearing 22 has a single dedicated axis of rotation (e.g. along pin 42) along the length of the cylinder.

Referring again to FIGS. 6*b*, 6*c*, the pawl 26 and base plate 23 combination can include a track 46 and guide 48 arrangement, such that aligned rotation of the pawl 25 about pin 26 can be assisted by movement of the guide 48 within the track 46, realizing that the track 46 could alternatively be located on the pawl 25 body and the guide 48 on the base plate 23. The track 46 could also be used to limit the magnitude of the rotational travel of the pawl 25, in essence an end of the track 46 acting as an abutment surface (i.e. stop) for the guide 48.

Referring to FIGS. 7*a*, 7*b*, 7*c*, 7*d*, shown is an alternative embodiment of the latch 20 having a pair of independent arms 40 for positioning the roller bearing 22 between the surfaces 34,36. Similarly to the embodiment shown in FIG. 6*a*, the arms 40 are attached to either side of the pawl 25 (e.g. at shaft 26) for holding the roller bearing 22. The roller bearing 22 is positioned between the arms 40 and mounted thereto by the mounting pin 42 acting as the fixed axis of rotation for the roller bearing 22, the mounting pin 42 projecting between the pair of arms 40 on either side of the body of the pawl 25. The arms 40 are independent from one another (i.e. no connection member 44 as in FIG. 6*d*) and instead are only coupled to one another via the body of the pawl 25 (e.g. via the connector 45 and/or the pin 26). Similar to the preceding embodiments referred to in FIGS. 1 to 5, the roller bearing 22 in the alternative embodiment of FIG. 7*a* can be positioned such that the bearing 22 can have a plurality of contacts (e.g. line contact) between an exterior surface of the roller bearing 22 and the surface(s) 34,36.

Referring to FIGS. 8*a*, 8*b*, 8*c*, 8*d*, shown is an alternative embodiment of the latch 20 having a single independent arm 40 for positioning the roller bearing 22 between the surfaces 34,36. Similarly to the embodiment shown in FIG. 6*a*, the arm 40 is attached to one side of the pawl 25 (e.g. at shaft 26) for holding the roller bearing 22 between the surfaces 34,36. The roller bearing 22 is positioned as extending from the single arm 40 and mounted thereto by the mounting pin 42 acting as the fixed axis of rotation for the roller bearing 22, the mounting pin 42 projecting from the single arm 40 positioned on one side of the body of the pawl 25. The arm is coupled the body of the pawl 25 (e.g. via the connector 45 and/or the pin 26). Similar to the preceding embodiments referred to in FIGS. 1 to 5, the roller bearing 22 in the alternative embodiment of FIG. 8*a* can be positioned such that the roller bearing 22 can have a plurality of contacts (e.g. line contact) between an exterior surface of the roller bearing 22 and the surface(s) 34,36.

As noted above for the ball bearing 22, it is recognized that the arm(s) 40, pin 42 and roller bearing 22 arrangement can be positioned on the ratchet 24 as desired, rather than the pawl 25, in order to position the roller bearing 22 between the surfaces 34,36.

We claim:

1. A latch comprising:

a housing having a slot for a striker;

a ratchet rotationally mounted on the housing and biased for release of the striker from the slot and retaining of the striker in the slot dependent upon an angular position of the ratchet with respect to the housing, the ratchet having a ratchet surface;

a pawl rotationally mounted on the housing and biased towards the ratchet, the pawl having a pawl surface; and a bearing cage positioned on a body of the pawl, the bearing cage containing a bearing in a structure allowing rotation of the bearing within the bearing cage during rotation of the ratchet and the pawl, such that during said rotation of the ratchet and the pawl, the rotation of the bearing within the bearing cage is induced by one or more contact regions between an exterior surface of the bearing and at least one of the pawl surface and the ratchet surface adjacently located relative to the exterior surface:

wherein the exterior surface of the bearing experiences rolling friction with respect to both the pawl surface as a cam surface and the ratchet surface as a cam surface during rotation of the pawl.

2. The latch of claim 1, wherein the one or more contact regions are one or more localized contact regions with respect to the exterior surface having a spheroidal shape.

3. The latch of claim 2, wherein the structure that allows rotation of the bearing within the bearing cage comprising a slot in one or more sidewalls of the bearing cage, and wherein an axis of rotation of the bearing varies in position as the bearing travels along the slot in the one or more sidewalls of the bearing cage.

4. The latch of claim 2, wherein the spheroidal shape is a sphere.

5. The latch of claim 2, wherein the bearing is a composite of a spheroid and a cylindroid.

6. The latch of claim 2, wherein the structure that allows rotation of the bearing within the bearing cage comprises a pair of slots, and wherein the bearing is a spheroid contained between a pair of opposed sidewalls of the bearing cage, the spheroid residing between the slot in each of the pair of opposed sidewalls such that the spheroid is free to rotate along a length of the slots.

7. The latch of claim 1, wherein the one or more contact regions comprises an elongated contact region with respect to the exterior surface having a cylindroid shape.

8. The latch of claim 1 further comprising a pair of opposed sidewalls of the bearing cage on the pawl, each sidewall of the pair of opposed sidewalls being on an opposite side of a body of the ratchet such that a portion of the body of the ratchet is overlapped by respective portions of the pair of opposed sidewalls during the rotation the pawl and the ratchet.

9. The latch of claim 1 further comprising a pair of sidewalls of the bearing cage on either side of a body of the ratchet such that a portion of the body of the ratchet is overlapped by respective portions of the sidewalls during the rotation of the pawl and the ratchet.

10. The latch of claim 1 further comprising a pair of opposed sidewalls of the bearing cage on the ratchet, each sidewall of the pair of opposed sidewalls being on an opposite side of a body of the pawl such that a portion of the body of the pawl is overlapped by respective portions of the pair of opposed sidewalls during relative movement between the pawl and the ratchet.

11. A latch comprising:

a housing having a slot for a striker;

a ratchet rotationally mounted on the housing and biased for release of the striker from the slot and retaining of the striker in the slot dependent upon an angular position of the ratchet with respect to the housing, the ratchet having a ratchet surface;

a pawl rotationally mounted on the housing and biased towards the ratchet, the pawl having a pawl surface; and a bearing positioned within a structure allowing rotation of the bearing between the pawl surface and the ratchet surface during rotation of the ratchet and the pawl, such that during said rotation of the ratchet and the pawl, the rotation of the bearing is induced by one or more localized contact regions between an exterior surface of the bearing and at least one of the pawl surface and the ratchet surface adjacently located relative to the exterior surface;

wherein the exterior surface has a spheroidal shape and the exterior surface of the bearing experiences rolling friction along both the pawl surface and the ratchet surface during rotation of the pawl.

12. The latch of claim 11, wherein the structure that allows rotation of the bearing comprises a bearing cage connected to the pawl and having a plurality of slots, and wherein an axis of rotation of the bearing is of variable position along the plurality of slots in the bearing cage connected to the pawl.

13. The latch of claim 11, wherein the spheroidal shape is a sphere.

14. The latch of claim 11, wherein the bearing is a composite of a spheroid and a cylindroid.

15. The latch of claim 11 wherein the structure allowing rotation of the bearing comprises a bearing cage located on the pawl and having a pair of opposed sidewalls of a bearing cage on the pawl, the bearing cage containing the bearing, each sidewall of the pair of opposed sidewalls being on an opposite side of a body of the ratchet such that a portion of the body of the ratchet is overlapped by respective portions of the pair of opposed sidewalls during the rotation of the pawl and the ratchet.

16. The latch of claim 11 further comprising a pair of opposed sidewalls of a bearing cage on the ratchet, the bearing cage containing the bearing, each sidewall of the pair of opposed sidewalls being on an opposite side of a body of the pawl such that a portion of the body of the pawl overlaps a portion of the pair of opposed sidewalls during relative movement between the pawl and the ratchet.

17. The latch of claim 11, wherein the structure allowing rotation of the bearing comprises a bearing cage, and wherein the bearing is a spheroid contained between a pair of opposed sidewalls of the bearing cage, the spheroid residing between a slot in each of the pair of opposed sidewalls such that the spheroid is free to rotate along a length of the slots.

18. The latch of claim 17, wherein the bearing cage is on the ratchet.

19. A latch comprising:

a housing having a slot for a striker;

a ratchet rotationally mounted on the housing and biased for release of the striker from the slot and retaining of the striker in the slot dependent upon an angular position of the ratchet with respect to the housing, the ratchet having a ratchet surface;

a pawl rotationally mounted on the housing and biased towards the ratchet, the pawl positioned at an initial primary latched position when the ratchet retains the striker in the slot, the pawl having a pawl surface; and a bearing cage coupled to the pawl, the bearing cage containing a bearing in a structure allowing rotation of the bearing within the bearing cage, such that wherein as the pawl is rotated about a pawl pivot axis from the initial primary latched position, the bearing is driven by the pawl to induce the rotation of the bearing within the bearing cage at a contact region between an exterior surface of the bearing and the pawl surface adjacently located relative to the exterior surface;

wherein the exterior surface of the bearing experiences rolling friction along both the pawl surface and the ratchet surface during rotation of the pawl.

20. The latch of claim 19, wherein the bearing cage is coupled to the pawl pivot axis by a body of the pawl.

21. The latch of claim 19, wherein the bearing cage includes one or more arms, the one or more arms are coupled to a body of the pawl at the pawl pivot axis.

22. The latch of claim 19, wherein said rotation of the bearing is provided during a rotation of the ratchet.

23. A latch comprising:

a housing having a slot for a striker;

a ratchet rotationally mounted on the housing and biased for release of the striker from the slot and retaining of the striker in the slot dependent upon an angular position of the ratchet with respect to the housing, the ratchet having a ratchet surface;

a pawl rotationally mounted on the housing and biased towards the ratchet, the pawl positioned at an initial primary latched position when the ratchet retains the striker in the slot, the pawl having a pawl surface; and a bearing positioned within a structure allowing rotation of the bearing between the pawl surface and the ratchet surface, such thatwherein as the pawl is rotated about a pawl pivot axis from the initial primary latched position, the bearing is driven by the pawl to induce the rotation of the bearing within the structure at a contact region between an exterior surface of the bearing and the pawl surface adjacently located relative to the exterior surface;

wherein the exterior surface has a spheroidal shape.

* * * * *